United States Patent [19]

Kubodera et al.

[11] Patent Number: 4,740,455

[45] Date of Patent: Apr. 26, 1988

[54] HEAT DEVELOPABLE LIGHT-SENSITIVE MATERIAL CONTAINING POLYMETHINE

[75] Inventors: Seiiti Kubodera; Masaki Okazaki, both of Kanagawa, Japan

[73] Assignee: Fuji Photo Film Co., Ltd., Kanagawa, Japan

[21] Appl. No.: 893,851

[22] Filed: Aug. 6, 1986

[30] Foreign Application Priority Data

Aug. 6, 1985 [JP] Japan ..... 60-172967

[51] Int. Cl.[4] ..... G03C 1/12

[52] U.S. Cl. ..... 430/617; 430/353; 430/576

[58] Field of Search ..... 430/617, 576, 353

[56] References Cited

U.S. PATENT DOCUMENTS 4,524,128 6/1985 Edwards ..... 430/353
4,617,257 10/1986 Sawada et al. ..... 430/619
4,677,051 6/1987 Kubodera ..... 430/617

*Primary Examiner*—J. David Welsh
*Attorney, Agent, or Firm*—Sughrue, Mion, Zinn, Macpeak, and Seas

[57] ABSTRACT

A novel heat developable light-sensitive material is provided comprising a silver halide spectrally sensitized by a polymethine containing at least one basic nucleus wherein the dye contains, as a group for substituting nitrogen atoms in said basic nucleus, at least one of the groups represented by general formulae (A) and (B):

(A)

$-(CH_2-)_2NHSO_2R$ wherein m represents an integer of 1 or 2; Y represents an atomic group necessary for the formation of a cyclic imide group; and R represents a $C_{1-4}$ alkyl group.

In a preferred embodiment, the atomic group represented by Y is selected from the group consisting of a succinic acid imido group, a phthalic acid imido group, an orthobenzosulfimido group, and a maleimido group. The atomic group may be optionally substituted by a halogen atom, a nitro group, a carboxyl group, an acylamino group such as an acetylamino group, or an alkoxycarbonyl amino group such as an ethoxycarbonyl group.

14 Claims, No Drawings

HEAT DEVELOPABLE LIGHT-SENSITIVE MATERIAL CONTAINING POLYMETHINE

FIELD OF THE INVENTION

The present invention relates to a heat development light-sensitive material. More particularly, the present invention relates to a heat developable light-sensitive material containing a silver halide spectrally sensitized by a sensitizing dye capable of providing a high spectral sensitivity and which exhibits an excellent effect with respect to undesired fading due to heat.

BACKGROUND OF THE INVENTION

The photographic process utilizing a silver halide shows excellent photographic properties such as sensitivity and gradation adjustability as compared to other photographic processes such as electrophotography and diazo photographic processes and, thus, has long been put into wide spread commercial application. In recent years, in processes for the formation of images on a light-sensitive material using a silver halide, techniques for simple and rapid formation of images have been developed by switching from the conventional wet processes using a developing agent to dry processes developed by heating or similar means.

Heat developable light-sensitive materials are well-known in the art. Examples of heat developable light-sensitive materials and their concomitant processes are described in, for example, *SHASHIN KOGAKU NO KISO* (published by Corona, pp. 553–555), Nebletts' *Handbook of Photography and Reprography,* (7th edition, published by Van Northrand Reinhold Company, pp. 32–33), U.S. Pat. Nos. 3,152,194, 3,301,678, 3,392,020, and 3,457,075, British Patents Nos. 1,131,108 and 1,167,777 and *Research Disclosure* RD No. 17029 (June-1978 issue, pp. 9–15).

Many processes for obtaining color images have been proposed. Processes for forming color images by a coupling reaction of an oxidation product of a developing agent and a coupler have been proposed. For example, the coupling of a p-phenylenediamine reducing agent and a phenol-based or active methylene coupler is proposed in U.S. Pat. No. 3,531,286. Further, a p-aminophenol-based reducing agent is proposed in U.S. Pat. No. 3,761,270, a sulfonamidophenol-based reducing agent is proposed in Belgian Patent No. 802,519 and *Research Disclosure* (September-1975 issue, pp. 31–32), and a combination of a sulfonamidophenol-based reducing agent and a 4-equivalent coupler is proposed in U.S. Pat. No. 4,021,240.

As to processes for the formation of positive color images by a light-sensitive silver dye bleaching process, examples of useful dyes and bleaching processes are described in *Research Disclosure, No.* 14433 (April-1976 issue, pp. 30–32) and *Research Disclosure,* No. 15229 (December-1976 issue, pp. 14–15) and U.S. Pat. No. 4,235,957.

Furthermore, examples of heat developing image formation processes utilizing a compound which originally contains a dye portion and can release a mobile dye in correspondence to or in counter-correspondence to a reduction reaction of a silver halide to silver at an elevated temperature, are disclosed in, for example, European Patent Nos. 76,492A and 79,056A and Japanese patent application (OPI) Nos. 28928/83 and 26008/83 (the term "OPI" as used herein refers to a "published unexamimed application").

A silver halide used in such a heat developable light-sensitive material is spectrally sensitized as necessary, as described in *Research Disclousre,* No. 17029 (June-1978 issue). However, unlike the conventional light-sensitive material which is developed by a processing solution containing a large amount of water, the heat developable light-sensitive material cannot remove "used" or previously reacted sensitizing dye therefrom by dissolving it into a treatment solution. Therefore, such "used" sensitizing dyes remain in the light-sensitive material after the heat development process. In the embodiment described in European Patent No. 76,492A in which a dye is transferred to a dye fixing material to obtain an image, a sensitizing dye is transferred to the dye fixing material together with the dye. This embodiment is disadvantageous in that the presence of a sensitizing dye may give rise to troublesome stains to images developed.

In order to eliminate such disadvantages, it is proposed in Japanese patent application (OPI) No. 111239/85 to employ a cyanine dye containing an atomic group which renders the dye capable of being faded upon application of heat to the photothermographic material. However, prior art "heat-fading dyes" as described in the above-mentioned patent are disadvantageous in some respects. For example, these "heat-fading" dyes are not fully capable of spectrally sensitizing a silver halide.

SUMMARY OF THE INVENTION

Therefore, it is an object of the present invention to provide a heat developable light-sensitive material which provides a higher spectral sensitivity and exhibits less stains than heretofore known photothermographic materials.

The above and other objects of the present invention will become more apparent from the following detailed description of the invention and examples.

These objects of the present invention are accomplished by using a spectral sensitizer which is a polymethine dye containing at least one basic nucleus, wherein the dye contains as a group for substituting nitrogen atoms in the basic nucleus at least one of the groups shown below:

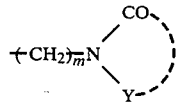

(A)

$-(CH_2)_2NHSO_2R$ (B)

wherein m represents an integer of 1 or 2; Y represents an atomic group necessary for the formation of a cyclic imido group; and R represents a $C_{1-4}$ alkyl group. The atomic group represented by Y is selected from the group consisting of a succinic acid imido group, a phthalic acid imido group, an orthobenzosulfimide group, and a maleimido group. These groups may be substituted by a halogen atom, a nitro group, a carboxyl group, an acylamino group such as an acetylamino group, or an alkoxycarbonyl group such as an ethoxycarbonyl group.

DETAILED DESCRIPTION OF THE INVENTION

Specific examples of the substituent groups represented by (A) include those shown below:

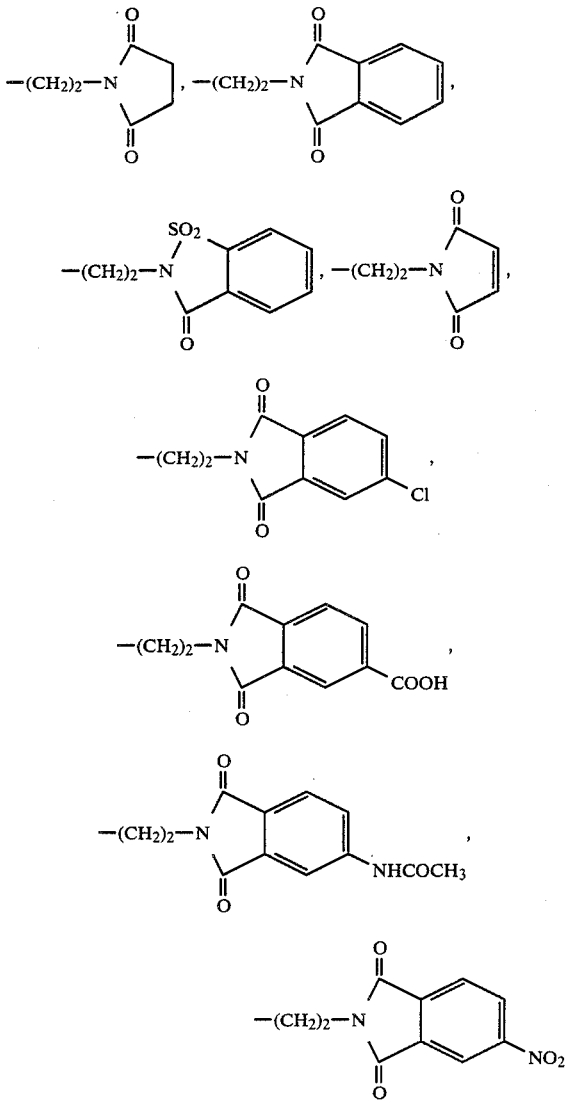

Specific examples of the substituent group represented by (B) include $-(CH_2)_2-NHSO_2CH_3$, $-(CH_2)_2-NHSO_2C_2H_5$, $-(CH_2)_2-NHSO_2C_3H_7(n)$, and $-(CH_2)_2NHSO_2C_4H_9(n)$.

On the other hand, the term "basic nucleus" as used herein is given the same definition as described in *The Theory of the Photographic Process* (4th edition; edited by T. H. James; published by Macmillan, New York, London, 1977, Article 8).

The term "polymethine dye" as used herein is given the same definition as described in *Heterocyclic Compounds-Cyanine Dyes and Related Compounds* (edited by F. M. Hamer; published by John Wiley & Sons, New York, London, 1964). Specific examples of such a dye include those represented by the following general formulae:

General formula (I)

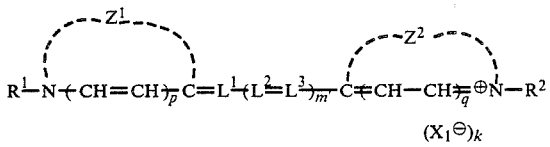

wherein $Z^1$ and $Z^2$, which may be the same or different, each represents a non-metallic atomic group necessary for the formation of a 5- or 6-membered heterocyclic ring; $R^1$ and $R^2$, which may be the same or different, each represents a substituted or unsubstituted alkyl group, the groups represented by (A) and (B) being contained in either $R^1$ or $R^2$; $L^1$, $L^2$ and $L^3$ each represents a substituted or unsubstituted methine group; p and q each represents 0 or 1; m' represents 0, 1, 2, or 3; $X_1^{\ominus}$ represents an anion; and k represents 0 or 1;

General formula (II)

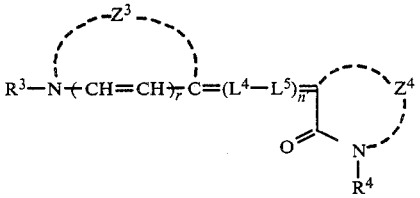

wherein $Z^3$ has the same meaning as $Z^1$ and $Z^2$ above; $R^3$ has the same meaning as $R^1$ and $R^2$ above; $L^4$ and $L^5$ each has the same meaning as $L^1$, $L^2$ and $L^3$ above; $Z^4$ represents a non-metallic atomic group necessary for the formation of a 5- or 6-membered heterocyclic ring; $R^4$ represents a hydrogen atom or a substituted or unsubstituted alkyl group, a substituted or unsubstituted aryl group or a heterocyclic group, the groups represented by (A) and (B) being contained in $R^3$; r has the same meaning as p and q above; and n' has the same meaning as m' above.

General formula (III)

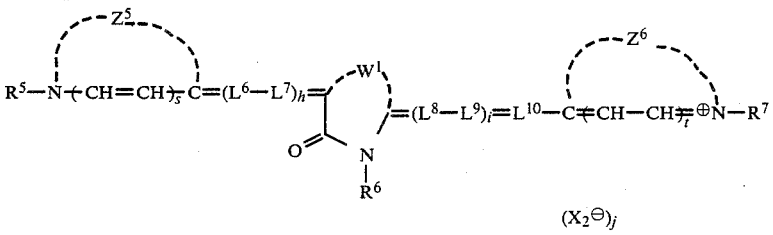

wherein $Z^5$ and $Z^6$ each has the same meaning as $Z^1$ and $Z^2$ above; $R^5$ and $R^7$ each has the same meaning as $R^1$ and $R^2$ above; $R^6$ has the same meaning as $R^4$ above; $L^6$, $L^7$, $L^8$, $L^9$ and $L^{10}$ each has the same meaning as $L^1$, $L^2$ and $L^3$ above; $W^1$ represents an atomic group necessary for the formation of a 5- or 6-membered heterocyclic ring, the groups represented by (A) and (B) being contained in either $R^5$ or $R^7$; h and i each has the same meaning as m' above; s and t each has the same meaning as p and q above; $X_2\ominus$ has the same meaning as $X_1\ominus$ above; and j has the same meaning as k above.

General formula (IV)

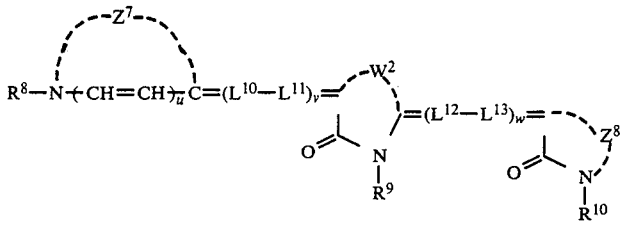

wherein $Z^7$ has the same meaning as $Z^1$ and $Z^2$ above; $Z^8$ has the same meaning as $Z^4$ above; $W^2$ has the same meaning as $W^1$ above; $R^8$ has the same meaning as $R^1$ and $R^2$ above; $R^9$ and $R^{10}$ each has the same meaning as $R^4$ above; $L^{10}$, $L^{11}$, $L^{12}$ and $L^{13}$ each has the same meaning as $L^1$, $L^2$ and $L^3$ above, the groups represented by (A) and (B) being contained in $R^8$; v and w each has the same meaning as m' above; and u has the same meaning as p and q above.

General formula (V)

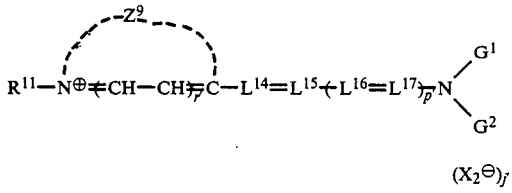

wherein $Z^9$ has the same meaning as $Z^1$ and $Z^2$ above; $R^{11}$ has the same meaning as $R^1$ and $R^2$ above; $L^{14}$, $L^{15}$, $L^{16}$ and $L^{17}$ each has the same meaning as $L^1$, $L^2$ and $L^3$ above; r' has the same meaning as p and q above; $X_2\ominus$ has the same meaning as $X_1\ominus$ above; j' has the same meaning as k above; p' represents 0, 1 or 2; and $G^1$ and $G^2$, which may be the same or different, each represents a hydrogen atom, a substituted or unsubstituted alkyl group, or a substituted or unsubstituted aryl group, or $G^1$ and $G^2$ together form a ring derived from a cyclic secondary amine, with the proviso that the groups represented by (A) and (B) are contained in $R^{11}$.

Examples of such a 5- or 6-membered heterocyclic ring formed by $Z^1$, $Z^2$, $Z^3$, $Z^5$, $Z^6$, $Z^7$, or $Z^9$ include a thiazole nucleus such as thiazole, 4-methylthiazole, 4-phenylthiazole, 4,5-dimethylthiazole and 4,5-diphenylthiazole; a benzothiazole nucleus such as benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-nethoxybenzothiazole, 6-methoxybenzothiazole, 5-ethoxybenzothiazole, 5-carboxybenzothiazole, 5-phenethylbenzothiazole, 5-fluorobenzothiazole, 5-chloro-6-methylbenzothiazole, 5,6-dimethylbenzothiazole, 5-hydroxy-6-methylbenzothiazole, tetrahydrobenzothiazole and 4-phenylbenzothiazole; a naphthothiazole nucleus such as naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole and 5-methoxynaphtho[2,3-d]thiazole; a thiazoline nucleus such as thiazole, 4-methylthiazoline and 4-nitrothiazoline; an oxazole nucleus such as oxazole, 4-methyloxazole, 4-nitrooxazole, 5-methyloxazole, 4-phenyloxazole, 4,5-diphenyloxazole and 4-ethyloxazole; a benzoxazole nucleus such as benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole and 5-ethoxybenzoxazole; a naphthoxazole nucleus such as naphtho[2,1-d]oxazole, naphtho[1,2-D]oxazole, naphtho[2,3-d]oxazole and 5-nitronaphtho[2,1-d]oxazole; an isoxazole nucleus such as 5-methylisoxazole and benzoisoxazole; an oxazoline nucleus such as 4,4-dimethyloxazole; a selenazole nucleus such as 4-methylselenazole, 4-nitroselenazole and 4-phenylselenazole; a benzoselenazole nucleus such as benzoselenazole, 5-chlorobenzoselenazole, 5-nitrobenzoselenazole, 5-methoxybenzoselenazole, 5-hydroxybenzoselenazole, 6-nitrobenzoselenazole and 5-chloro-6-nitrobenzoselenazole; a naphthoselenazole nucleus such as naptho[2,1-d]selenazole and naphtho[1,2-d]selenazole; a tetrazole nucleus such as benzotetrazole, 5-methylbenzotetrazole, 5,6-dimethylbenzotetrazole, 5-methoxybenzotetrazole, 5-hydroxybenzotetrazole, 5-methylthiobenzotetrazole, 5,6-dimethoxybenzotetrazole, naphtho[1,2-d]tetrazole, 8-methylnaphtho[1,2-d]tetrazole and 6-methoxynaphtho[1,2-d]tetrazole; a 3,3-dialkylindolenine nucleus such as 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine and 3,3-dimethyl-5-chloroindolenine; an imidazole nucleus such as 1-alkylimidazoles, 1-alkyl-4-phenylimidazoles, 1-alkylbenzoimidazoles, 1-alkyl-5-chlorobenzoimidazoles, 1-alkyl-5,6-dichlorobenzoimidazoles, 1-alkyl-5-methoxybenzoimidazoles, 1-alkyl-5-cyanobenzoimidazoles, 1-alkyl-5-fluorobenzoimidazoles, 1-alkyl-5-trifluoromethylbenzoimidazoles, 1-alkyl-6-chloro-5-cyanobenzoimidazoles, 1-alkyl-6-chloro-5-trifluoromethylbenzoimidazoles, 1-alkylnaphtho[1,2-d]imidazoles, 1-allyl-5,6-dichlorobenzoimidazole, 1-allyl-5-chlorobenzoimidazole, 1-arylimidazoles, 1-arylbenzoimidazoles, 1-aryl-5-chlorobenzoimidazoles, 1-aryl-5,6-dichlorobenzoimidazoles, 1-aryl-5-methoxyimidazoles, 1-aryl-5-cyanobenzoimidazoles and 1-arylnaphtho[1,2-d]imidazoles, wherein the above-described alkyl group is preferably a $C_{1-8}$ alkyl group such as an unsubstituted alkyl group (e.g. a methyl group, an ethyl group, a propyl group, an isopropyl group and a butyl group) and a hydroxyalkyl group (e.g. a 2-hydroxyalkyl group and a 3-hydroxypropyl group), with a methyl group and an ethyl group being most preferred, and the above-described aryl group represents a phenyl group, a halogen (e.g., chlorine)-substituted phenyl group, or an alkyl (e.g., methyl)-substituted phenyl group, an alkoxy (e.g., methoxy)-substituted phenyl group; a pyridine nucleus such as 2-pyridine, 4-pyridine, 5-methyl-2-pyridine and 3-methyl-4-pyridine; a quinoline nucleus such as 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro-1-isoquinoline, 3,4-dihydro-1-isoquinoline and 6-nitro-3-isoquinoline; an imidazo[4,5-b]quinoxaline nucleus such as 1,3-diethylimidazo[4,5-b]quinoxaline and 6-chloro-1,3-diallyimidazo[4,5-b]quinoxaline; an oxadiazole nucleus; a thiadiazole nucleus; a tetrazole nucleus; and a pyrimidine nucleus.

$Z^4$ and $Z^8$ each represents an atomic group necessary for the formation of a 5- or 6-membered heterocyclic ring. Examples of such a heterocyclic ring include a rhodanine nucleus, a 2-thiohydantoin nucleus, a 2-thioxooxazolidin-4-one nucleus, a 2-pyrazolin-5-one nucleus, a barbituric acid nucleus, a 2-thiobarbituric acid nucleus, a thiazolidine nucleus, a 2,4-dione nucleus, a thiazolidin-4-one nucleus, an isoxazolone nucleus, a hydantoin nucleus and an indandione nucleus.

$R^4$, $R^6$, $R^9$ and $R^{10}$ are each bonded to nitrogen atoms contained in the above-described nuclei and represents a hydrogen atom, a $C_{1-18}$ (preferably $C_{1-7}$, most preferably $C_{1-4}$) alkyl group such as a methyl group, an ethyl group, a propyl group, an isopropyl group, a butyl group, an isobutyl group, a hexyl group, an octyl group, a dodecyl group and an octadecyl group; a substituted alkyl group such as an aralkyl group (e.g., a benzyl group and a 2-phenylethyl group), a hydroxyalkyl group (e.g., a 2-hydroxyethyl group and a 3-hydroxypropyl group), a carboxyalkyl group (e.g., a 2-carboxyethyl group, a 3-carboxypropyl group, a 4-carboxybutyl group and a carboxymethyl group), an alkoxyalkyl group (e.g., a 2-methoxyethyl group and a 2-(2-methoxyethoxy)ethyl group), a sulfoalkyl group (e.g., a 2-sulfoethyl group, a 3-sulfopropyl group, a 3-sulfobutyl group, a 4-sulfobutyl group, a 2-(3-sulfopropoxy)ethyl group, a 2-hydroxy-3-sulfopropyl group and a 3-sulfopropoxyethoxyethyl group), a sulfatoalkyl group (e.g., a 3-sulfatopropyl group and a 4-sulfatobutyl group), a heterocyclic substituted alkyl group (e.g., a 2-(pyrolidin-2-one-1-yl)ethyl group, a tetrahydrofurfuryl group and a 2-morpholinoethyl group), a 2-acetoxyethyl group, a carbomethoxymethyl group, and a 2-methanesulfonylaminoethyl group); an allyl group; an aryl group such as a phenyl group and a 2-naphthyl group; a substituted aryl group such as a 4-carboxyphenyl group, a 4-sulfophenyl group, a 3-chlorophenyl group and a 3-methylphenyl group; a heterocyclic group such as a 2-pyridyl group and a 2-thiazolyl group; and

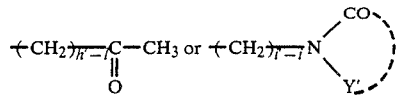

wherein h' and i' each represents an integer of 2 to 5, and Y' represents a cyclic imido group such as a succinic acid imido group, a phthalic acid imido group, an orthobenzosulfimido group and a maleimido group, and h' preferably represents 2 and i' represents 2 or 3.

$R^1$, $R^2$, $R^3$, $R^5$, $R^7$, $R^8$, and $R^{11}$ each represents a $C_{1-18}$ (preferably $C_{1-7}$, most preferably $C_{1-4}$) alkyl group such as a methyl group, an ethyl group, a propyl group, an isopropyl group, a butyl group, an isobutyl group, a hexyl group, an octyl group, a dodecyl group and an octadecyl group; a substituted alkyl group such as an aralkyl group (e.g., a benzyl group and a 2-phenylethyl group), a hydroxyalkyl group (e.g., a 2-hydroxyethyl group and a 3-hydroxypropyl group), a carboxyalkyl group (e.g., a 2-carboxyethyl group, a 3-carboxypropyl group, a 4-carboxybutyl group and a carboxymethyl group), an alkoxyalkyl group (e.g., a 2-methoxyethyl group and a 2-(2-methoxyethoxy)ethyl group), a sulfoalkl group (e.g., a 2-sulfoethyl group, a 3-sulfopropyl group, a 3-sulfobutyl group, a 4-sulfobutyl group, a 2-(3-sulfopropoxy)ehtyl group, a 2-hydroxy-3-sulfopropyl group and a 3-sulfopropoxyethoxyethyl group), a sulfatoalkyl group (e.g., a 3-sulfatopropyl group and a 4-sulfatobutyl group) and a heterocyclic substituted alkyl group (e.g., 2 2-(pyrolidin-2-one-1-yl)ethyl group and a tetrahydrofurfuryl group), a 2-acetoxyethyl group, a carbomethoxymethyl group and a 2-methanesulfonylaminoethyl group); an allyl group; the previously described group (A) or (B), and

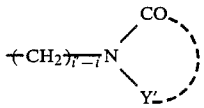

wherein Y' and i' are each as defined above.

In addition to the above, there may be used a styryl dye, a hemicyanine dye or an oxonole dye which contains methanesulfonylaminoethyl groups and organic acid groups at the same time.

Specific examples of such a polymethine dye are shown below, but the present invention should not be construed as being limited thereto.

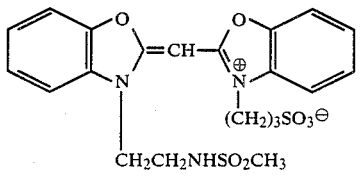

(1)

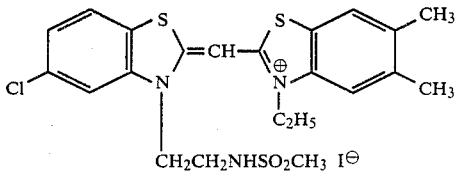

(2)

-continued
(3)
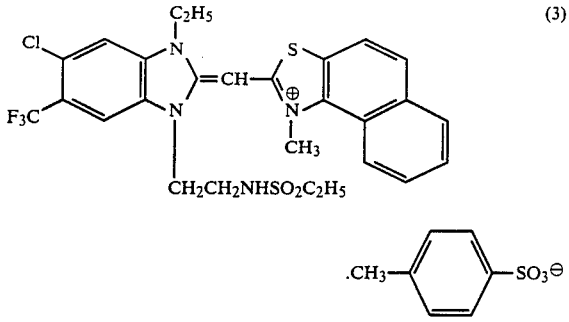
(4)
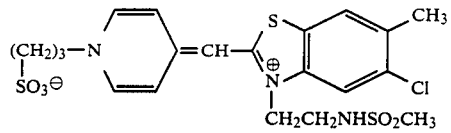
(5)
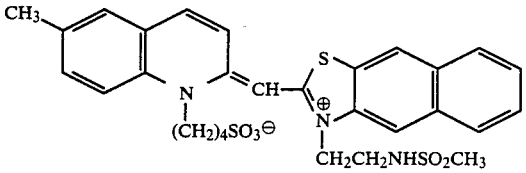
(6)
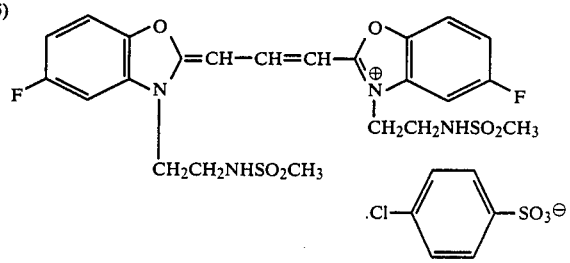
(7)
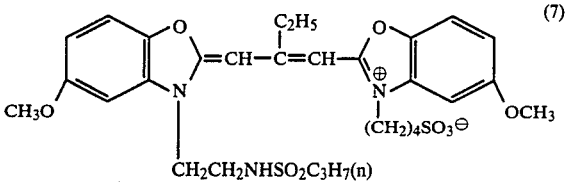
(8)
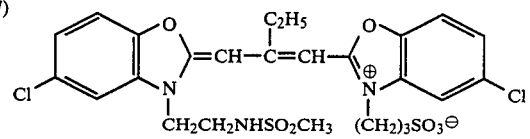
(9)
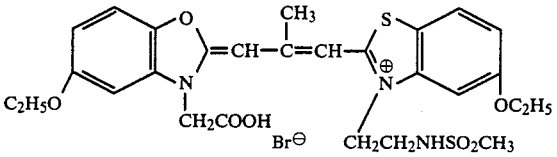
(10)
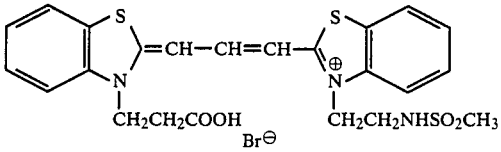
(11)
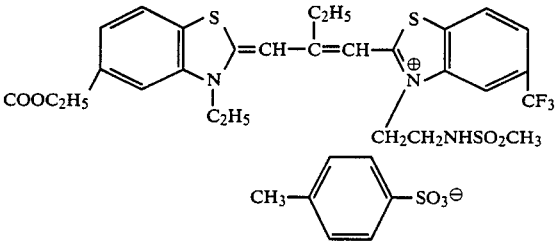
(12)
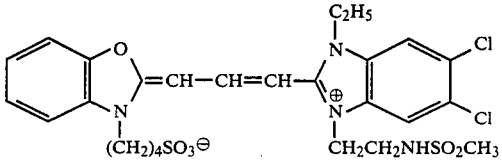
(13)
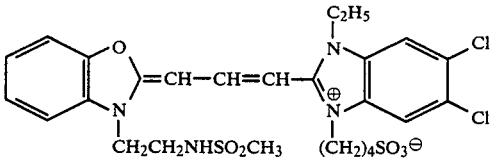
(14)
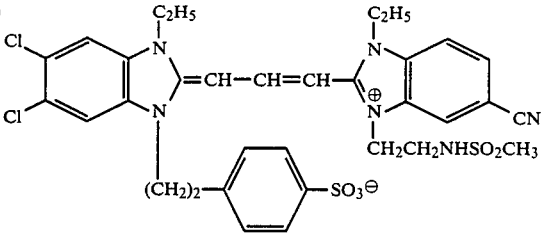
(15)
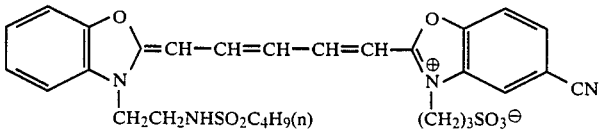

-continued
(16)
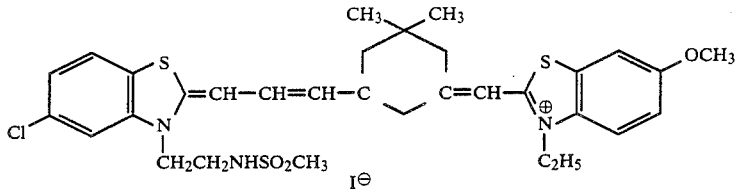
(17)
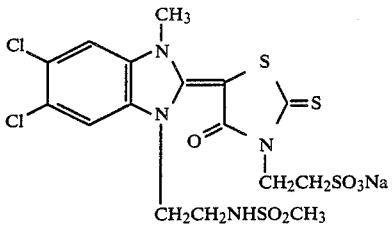
(18)
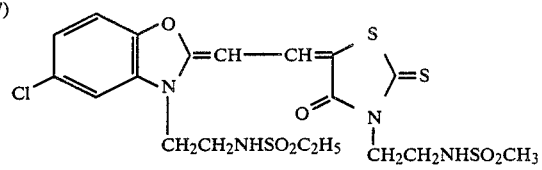
(19)
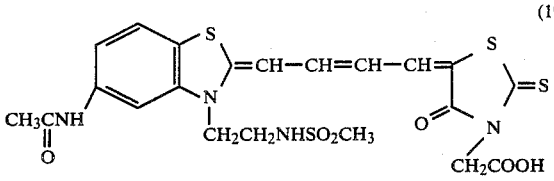
(20)
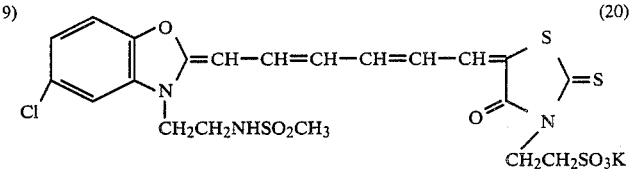
(21)
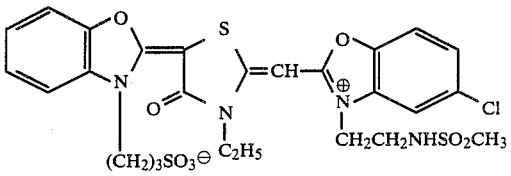
(22)
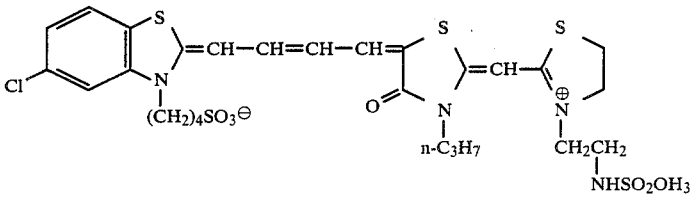
(23)
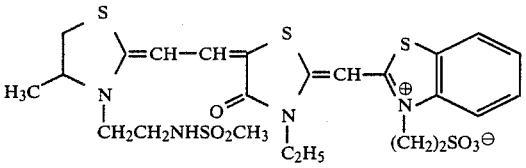
(24)
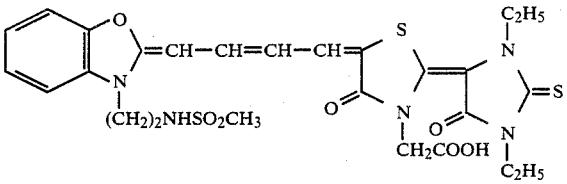
(25)
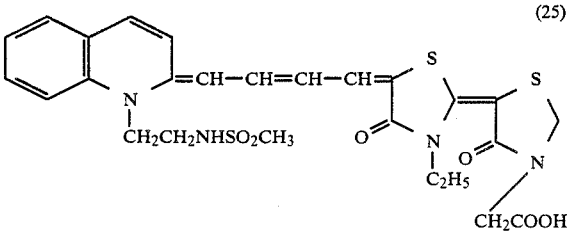
(26)
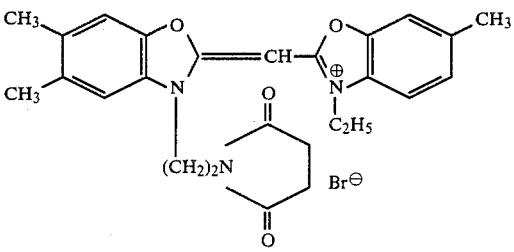

-continued
(27)
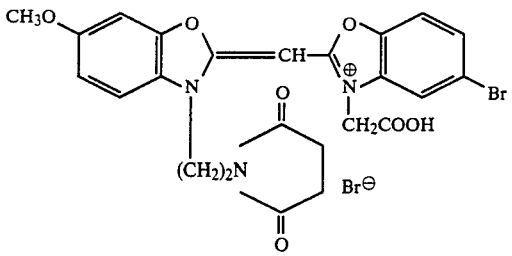
(28)
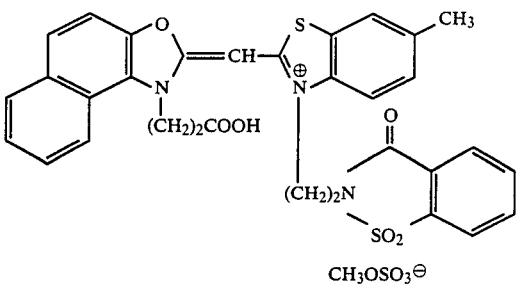
(29)
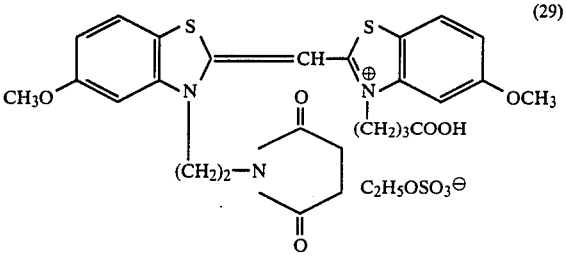
(30)
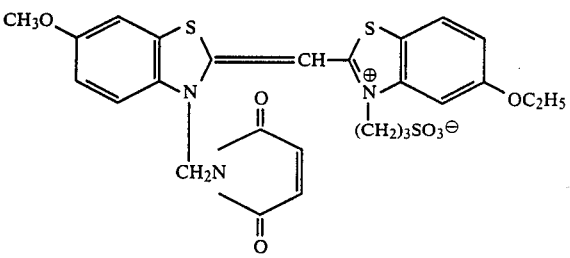
(31)
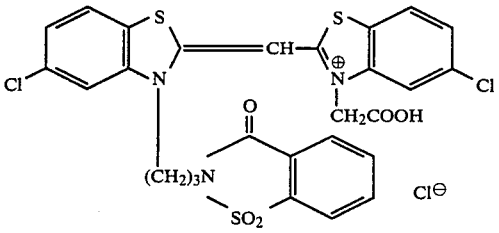
(32)
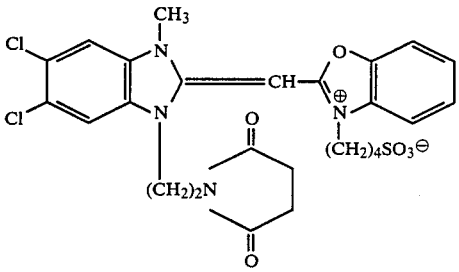
(33)
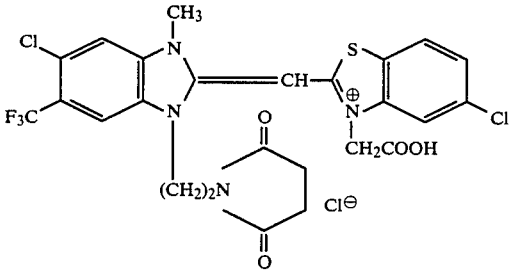
(34)
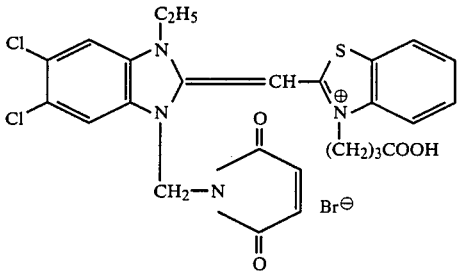
(35)
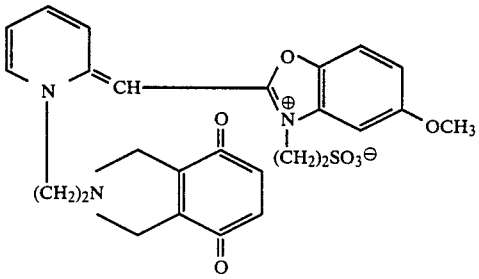
(36)
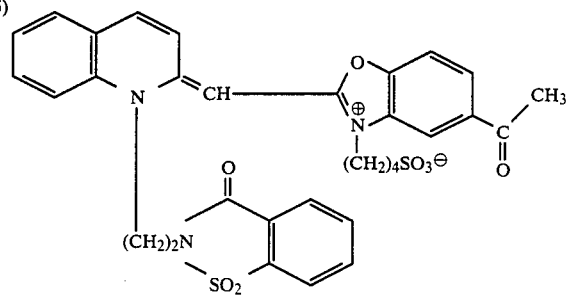

-continued
(37)
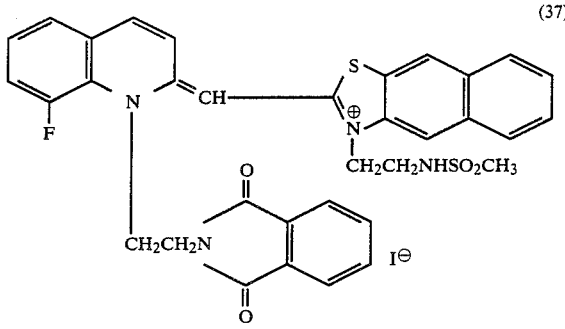
(38)
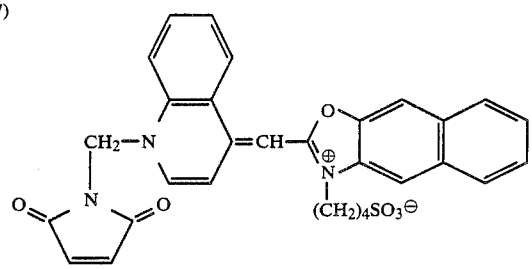
(39)
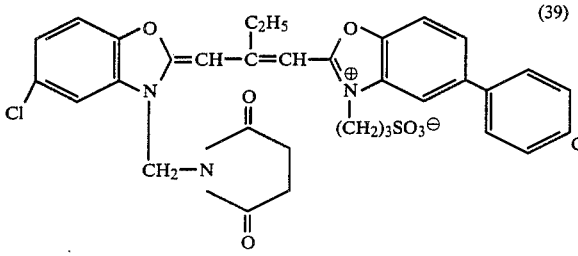
(40)
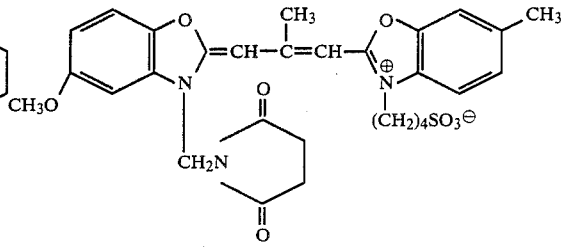
(41)
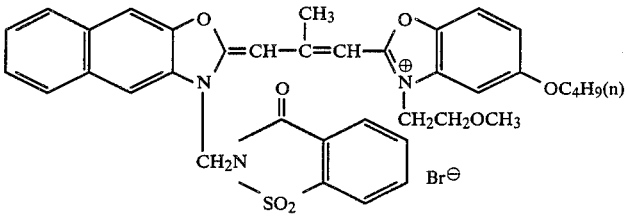
(42)
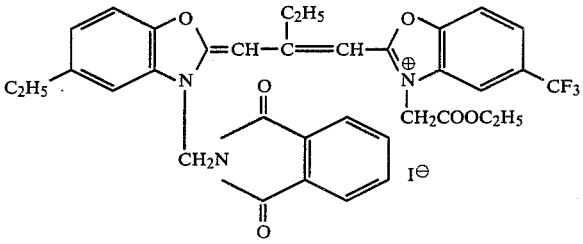
(43)
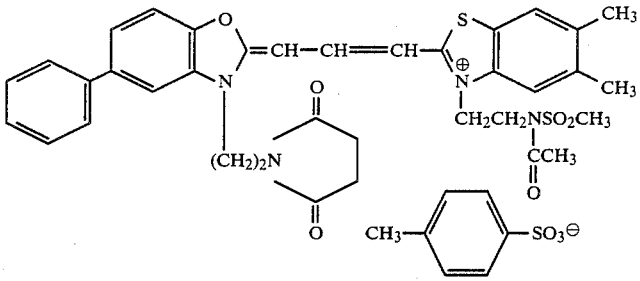
(44)
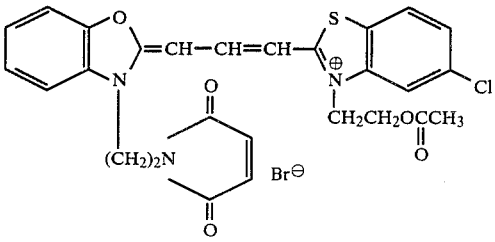

-continued
(45)
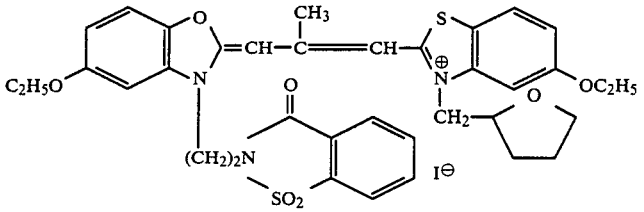
(46)
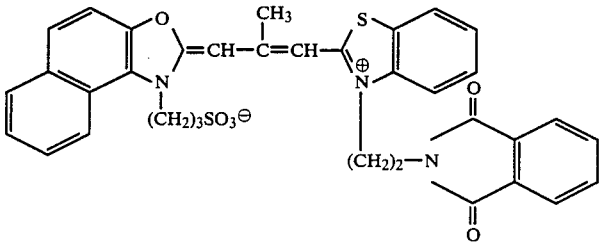
(47)
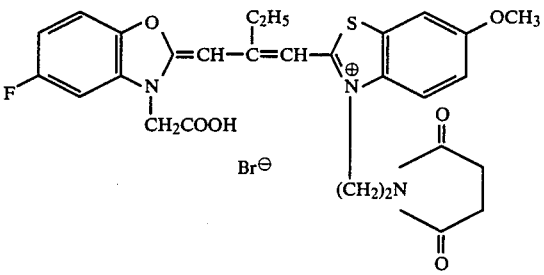
(48)
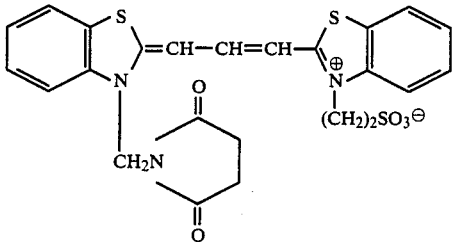
(49)
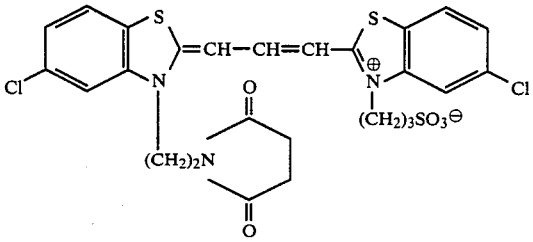
(50)
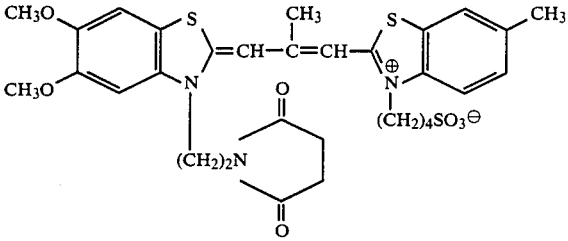
(51)
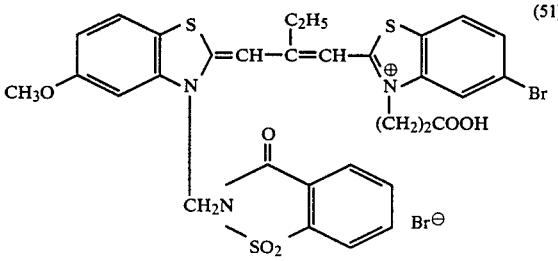
(52)
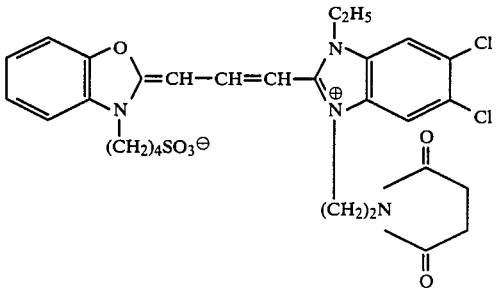

-continued
(53)
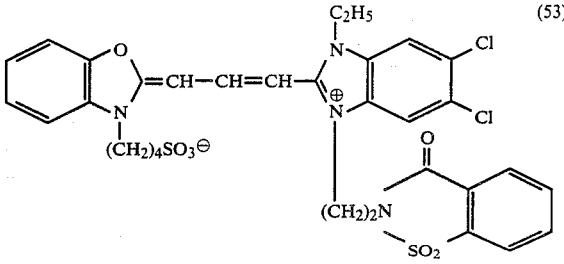
(54)
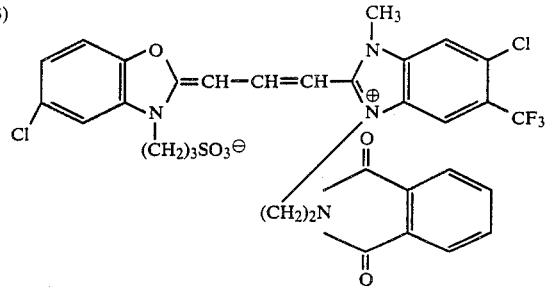
(55)
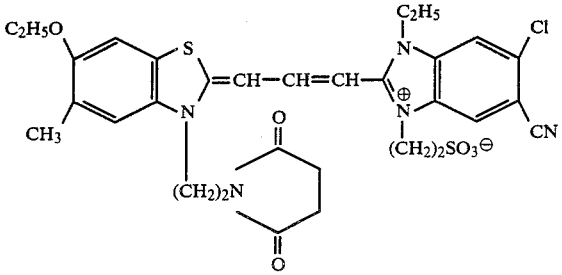
(56)
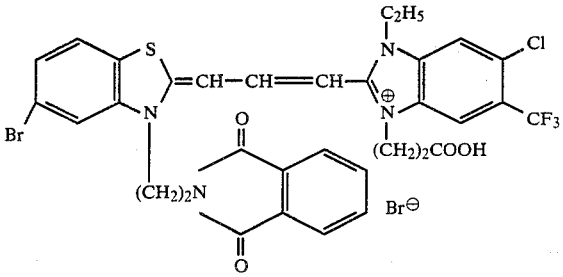
(57)
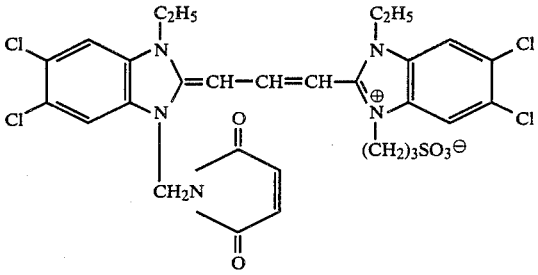
(58)
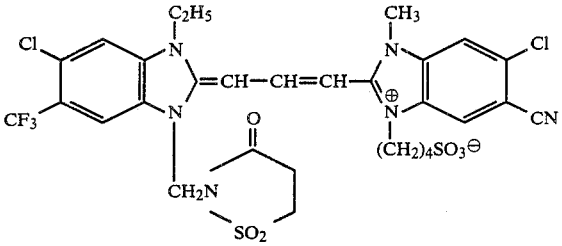
(59)
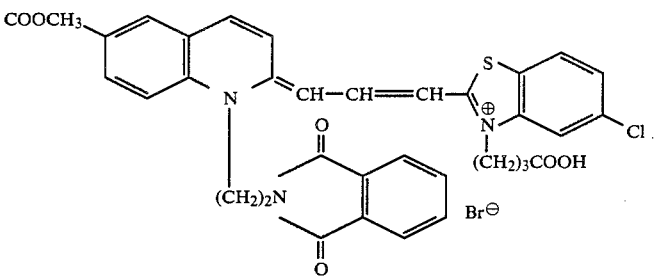
(60)
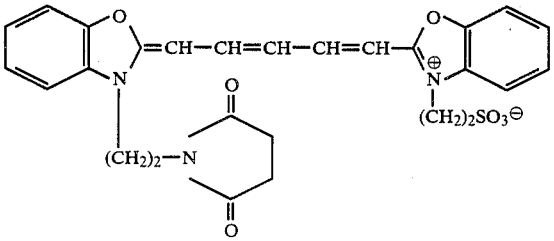
(61)
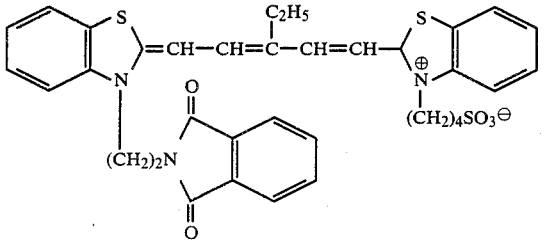

-continued
(62)
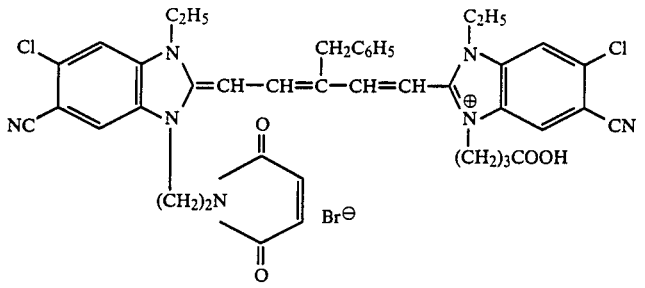
(63)
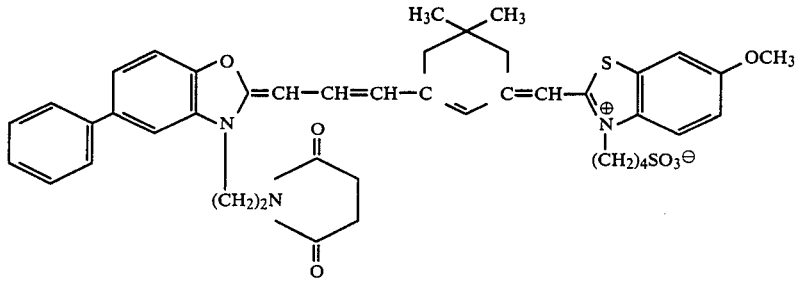
(64)
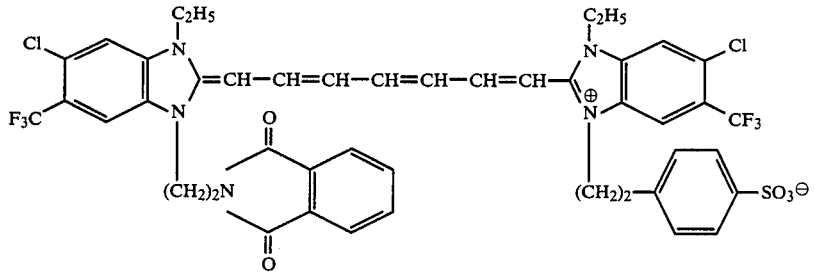
(65)
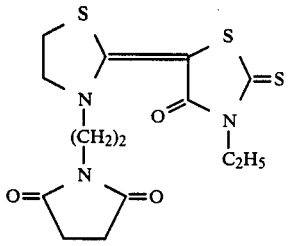
(66)
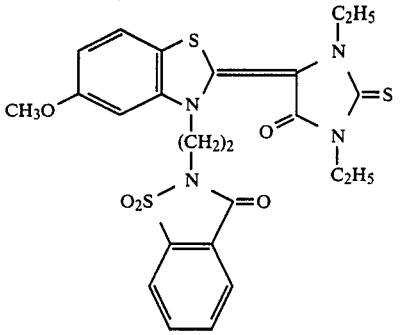
(67)
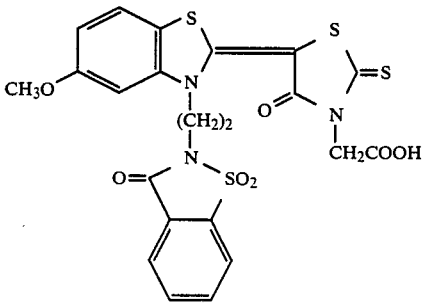
(68)
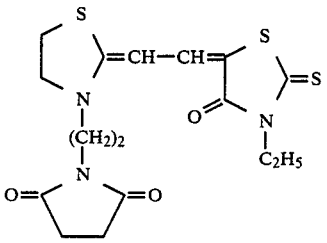

-continued
(69)
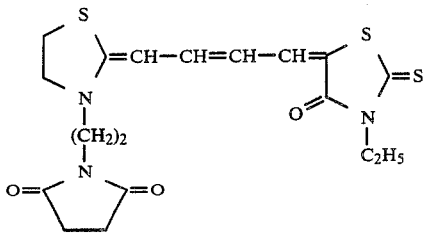
(70)
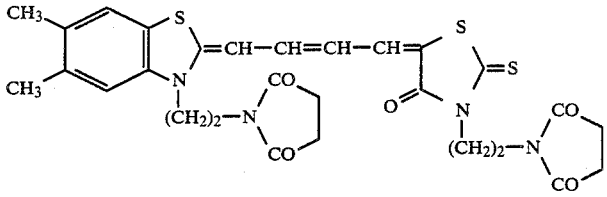
(71)
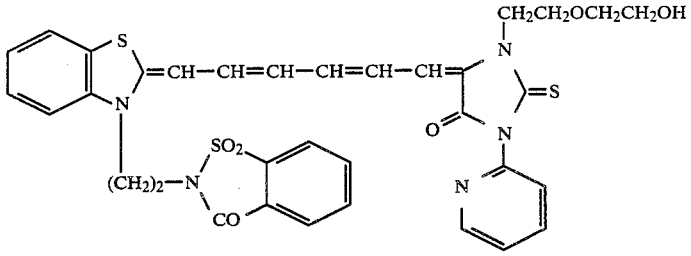
(72)
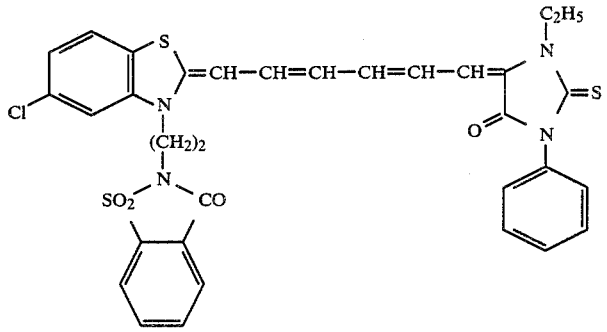
(73)
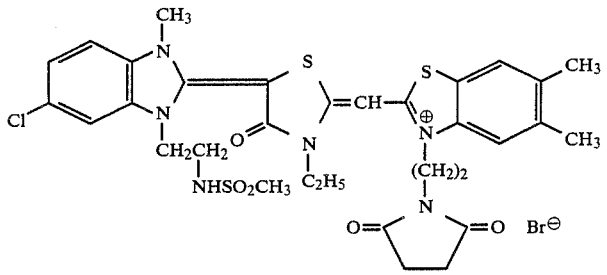
(74)
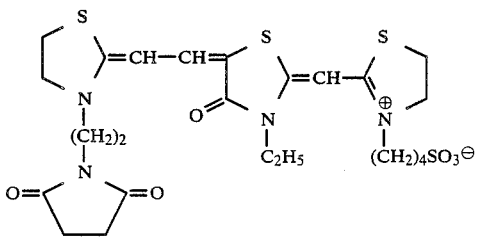
(75)
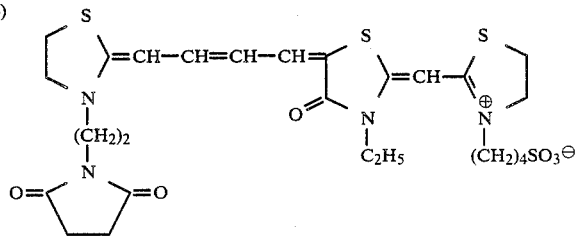

-continued
(76)
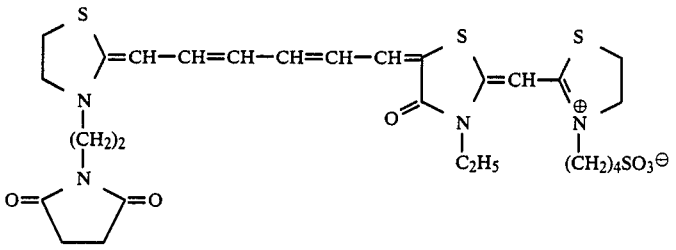
(77)
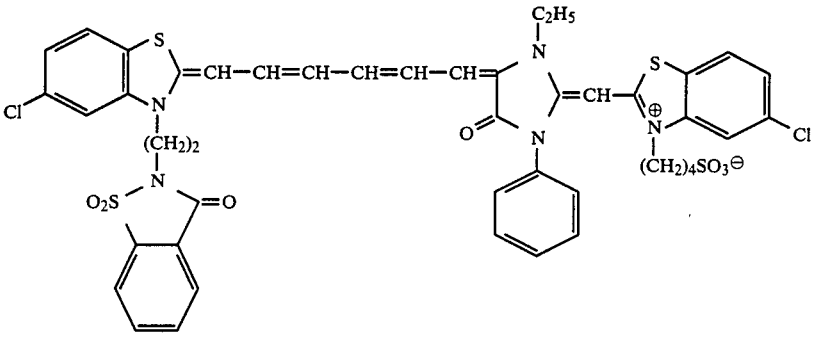
(78)
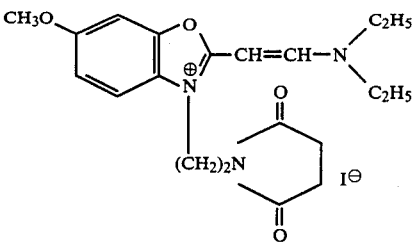
(79)
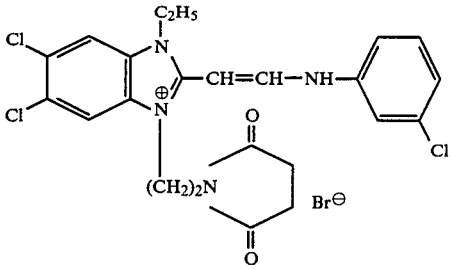
(80)
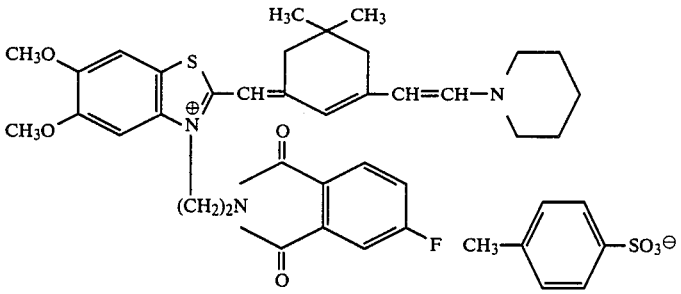
(81)
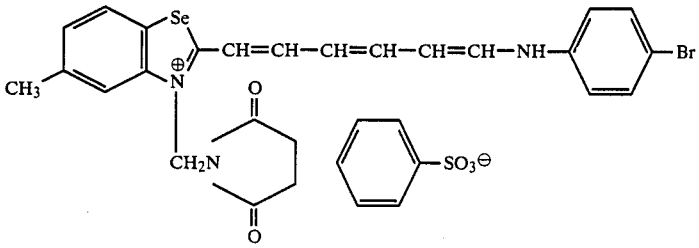

-continued

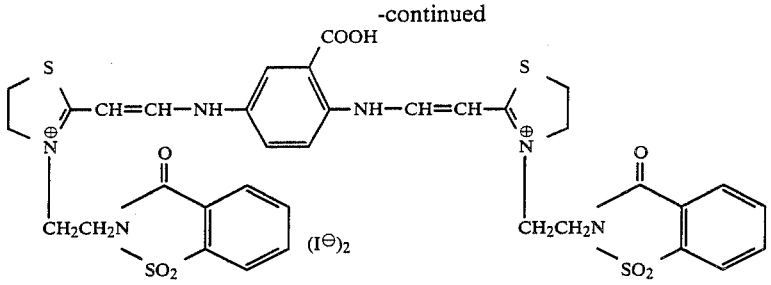

(82)

The sensitizing dyes represented by the general formulae (I), (II), (III), (IV) and (V) which may be used in the present invention can easily be prepared by any one of the processes described in *Heterocyclic Compounds—Cyanine Dyes and Related Compounds,* (chapter V, pages 116–147, edited by F. M. Hamer, published by John Wiley & Sons (New York, London), 1964), and *Heterocyclic Compounds—Special Topics in Heterocyclic Chemistry,* (chapter VIII, sec. IV, pages 482–515, edited by D. M. Sturmer, published by John Wiley & Sons (New York, London), 1977).

Examples or synthesis of typical compounds are described hereinafter below: Unless otherwise indicated, all percents, ratios and the like are by weight.

SYNTHESIS EXAMPLE 1

Synthesis of 5,6-dichloro-1-ethyl-3-(2-methanesulfonylaminoethyl)-2-methylbenzoimidazolium chloride 22.9 g (0.1 mol) of 5,6-dichloro-1-ethyl-2-methylbenzoimidazole and 23.6 g (0.15 mol) of N-(2-chloroethyl)-methanesulfonamide were put into a 200-ml three-necked flask equipped with a stirrer and heated with stirring for 2 hours on an oil bath which had been heated to a temperature of 150° C. Then, 20 ml of anisole was added to the mixture. The mixture was then allowed to cool to room temperature with stirring. The resulting crystals were filtered off, washed with acetone and isopropanol, and dried.

Yield: 35.8 g (90%).

SYNTHESIS EXAMPLE 2

Synthesis of Compound 12

9.7 gh (25 mmols) of 5,6-dichloro-1-ethyl-3-(2-methanesulfonylaminoethyl)-2-methylbenzoimidazolium chloride, 9.3 g (25 mmols) of 4-[2-(2-anilinovinyl)benzoxazolio-3]-butanesulfonate, 25 ml of acetic anhydride, and 500 ml of acetonitrile were put into a 1-l three-necked flask equipped with a stirrer and a dropping funnel. The mixture was stirred at room temperature with 35 ml of triethylamine added dropwise thereto. After the addition was finished, the mixture was continued to be stirred for 1 hour. The resulting crystal was filtered off.

The crystal was washed with acetonitrile and isopropanol, and then dried. The resulting crystal was put into a 2-l three-necked flask equipped with a stirrer. 1.5 l of methanol and 150 ml of a 10% aqueous solution of NaOH were added to the crystal. The admixture was stirred at room temperature for 1.5 hours. The reaction mixture was poured into a 3-l beaker with 750 ml of isopropanol. The resulting crystal was filtered off and washed with isopropanol. The crystal thus obtained was purified by the use of benzyl alcohol and isopropanol. Yield: 12.5 g (74.5%); m.p. 300° C. or above; $\lambda_{max}^{MeOH}=485$ nm

SYNTHESIS EXAMPLE 3

Synthesis of 5-chloro-3-(2-methanesulfonylaminoethyl)-2-methylbenzoxazolium-4-chlorobenzenesulfonate The desired crystal was obtained by carrying out the same synthesis as used in Synthesis Example 1 using 4.2 g (25 mmols) of 5-chloro-2-methylbenzoxazole and 15.7 g (50 mmols) of 2-methanesulfonylaminoethyl-4-chlorobenzenesulfonate. Yield: 7.3 g (60.8%).

SYNTHESIS EXAMPLE 4

Synthesis of Compound 8

4.8 g (10 mmols) of 5-chloro-3-(2-methanesulfonylaminoethyl)-2-methylbenzoxazolium-4-chlorobenzene sulfonate, 5.8 g (15 mmols) of 4-[5-chloro-2-(2-ethoxy-1-butenyl)benzoxazolio-3]-propanesulfonate, and 7 ml of N,N-dimethylacetamide were put into a 50-ml three-necked flask equipped with a stirrer and a thermometer. The admixture was heated with stirring for 1 hour on an oil bath which had been heated to a temperature of 140° C. After being allowed to cool to a temperature of 100° C., 30 ml of isopropanol was added to the mixture. The admixture was then allowed to cool to room temperature. The resulting crystal was filtered off, washed with isopropanol, and the purified by the use of chloroform and methanol to obtain the desired compound. Yield: 1.3 g (20.6%); m.p. 300° C. or above; $\lambda_{max}^{MeOH}=496.5$ nm.

SYNTHESIS EXAMPLE 5

Synthesis of 3-(2-methanesulfonylaminoethyl)rhodanine 30 g ($2.1\times10^{-1}$ mols) of 2-methanesulfonylaminoethylamine and 18.1 g ($2.3\times10^{-1}$ mols) of carbon bisulfide were dispersed into 10 ml of ethyl acetate. 32.8 g ($2.3\times10^{-1}$ mols) of triethylamine was added dropwise to the dispersion while stirring at room temperature. The admixture was allowed to react for about 4 hours while the internal temperature thereof was maintained at 40° C. 70 ml of ethanol was added to the reaction system. The resulting crystal was filtered off and then washed with 30 ml of ethanol to obtain 54.0 g of triethylammonium N-(2-methanesulfonylaminoethyl)dithiocarbamate as an intermediate product. 54.0 g ($1.7\times10^{-1}$ mols) of the thus-obtained triethylammonium N-(2-methanesulfonylaminoethyl)dithiocarbamate was dispersed into 75 ml of ethanol. The dispersion was stirred while the internal temperature thereof was maintained at 7° to 8° C. under ice cooling. 28.6 g ($1.7\times10^{-1}$ mols) of ethyl bromoacetate was added dropwise to the dispersion. The dispersion was stirred for about 1 hour while the internal temperature was maintained at 20° C. by suppressing heat generation under ice cooling. The dispersion was further stirred for about 1 hour at room temperature. The resulting reaction product was put into 300 ml of water. The aqueous mixture was extracted with 500 ml of ethyl acetate. The mixture was then washed with water. The resulting ethyl acetate layer was dried over anhydrous sodium sulfate. The ethyl acetate solution was filtered, and the filtrate was concentrated to obtain 43.7 g of 3-(2-methanesulfonylaminoethyl)rhodanine (yield: 100%).

The synthesis of 2-methanesulfonylaminoethylamine can be easily accomplished by, for example, the synthesis of a primary amine which is known as the Gabriel process.

SYNTHESIS EXAMPLE 6

Synthesis of N-(2-bromoethyl)succinimide 9.9 g of succinimide and 50 ml of N,N-dimethylformamide were put into a 200-ml three-necked flask equipped with a stirrer and a thermometer. 14 g of potassium carbonate was added to the mixture. The admixture was then stirred at room temperature for 30 minutes. 39.6 g of 1,2-dibromoethane was added to the admixture. The admixture was allowed to react at a temperature of 40° to 50° C. for 2 hours. The reaction mixture was poured into water. The aqueous mixture was then extracted with ethyl acetate. The ethyl acetate layer was dried over anhydrous sodium sulfate and concentrated under reduced pressure. The residue was crystallized with hexane. The resulting crystal was filtered off and then air-dried. Yield: 16.7 g (81%); m.p. 55° to 56° C.

SYNTHESIS EXAMPLE 7

Synthesis of 5,6-dichloro-1-ethyl-2-methyl-3-(2-succinimidoethyl)-benzoimidazolium bromide 11.5 g of 5,6-dichloro-1-ethyl-2-methylbenzoimidazole and 20.6 g of N-(2-bromoethyl)succinimide were put into a 200-ml three-necked flask equipped with a stirrer and a reflux condenser and heated for 2 hours on an oil bath which has been heated to a temperature of 130° C. 10 ml of anisole was added to the mixture. The admixture was then allowed to stand for cooling. 50 ml of ethyl acetate was added to the admixture. The admixture was then refluxed for 30 minutes. After being allowed to cool to room temperature, the resulting crystal was filtered off, washed with acetone, and then dried at a temperature of 50° C. for 5 hours. Yield: 18.7 g (86%).

SYNTHESIS EXAMPLE 8

Synthesis of Compound 79

11.0 g of 5,6-dichloro-1-ethyl-2-methyl-3-(2-succinimidoethyl)benzoimidazolium bromide and 13.3 g of N,N'-3,3'-dichlorodiphenyl)formamidine were put into a 100-ml three-necked flask equipped with a stirrer and a reflux condener and heated for 2 hours on an oil bath which had been heated to a temperature of 170° C. After being allowed to stand for cooling, 50 ml of isopropanol was added to the mixture. The admixture was then refluxed for 30 minutes. The reaction system was cooled on an ice bath to obtain a crystal which was then filtered off and washed with isopropanol. The resulting crystal was then recrystallized using activated carbon. Yield: 12.3 g (86%); m.p. 293° C. (decomposed).

SYNTHESIS EXAMPLE 9

Synthesis of N-(2-bromoethyl)-orthobenzosulfimide 3.6 g of orthobenzosulfimide and 10 ml of N,N-dimethylformamide were put into a 100-ml three-necked flask equipped with a stirrer and a thermometer. 2.8 g of potassium carbonate was added to the mixture. The admixture was then stirred at room temperature for 30 minutes. 5.7 g of 1,2-dibromoethane was added to the reaction system which was then allowed to react at a temperature of 40° to 50° C. for 2 hours. The reaction mixture was then poured into water. The aqueous mixture was extracted with ethyl acetate. The ethyl acetate layer was dried over anhydrous sodium sulfate and then concentrated under reduced pressure to obtain an oil-like material as the desired product. Yield: 4.4 g (78%).

SYNTHESIS EXAMPLE 10

Synthesis of 5,6-dichloro-1-ethyl-2-methyl-3-(2-orthobenzosulfimidoethyl)benzoimidazolium bromide 2.3 g of 5,6-dichloro-1-ethyl-2-methylbenzoimidazole and 2.9 g of N-(2-bromoethyl)-orthobenzosulfimide were put into a 100-ml three-necked flask equipped with a stirrer and a reflux condenser and heated for 3 hours on an oil bath which had been heated to a temperature of 120° C. Thereafter, the oil bath was withdrawn, and the mixture was allowed to stand for cooling. 50 ml of acetone was added to the reaction system so that the precipitated crystal came loose. After being allowed to stand at room temperature for 2 hours, the crystal was filtered off, washed with acetone, and then dried at a temperature of 50° C. for 5 hours. Yield: 4.1 g (80%).

SYNTHESIS EXAMPLE 11

Synthesis of Compound 53

0.85 g of 5,6-dichloro-1-ethyl-2-methyl-3-(2-orthobenzosulfimidoethyl)benzoimidazolium bromide, 1.0 g of 4-[2-(2-anilinovinyl)benzoxazolio-3]-butanesulfonate, 0.7 g of acetic anhydride and 35 ml of acetonitrile were put into a 100-ml three-necked flask equipped with a stirrer and a reflux condenser and heated on a steam bath for 5 minutes. 2.5 g of triethylamine was added to the reaction mixture. The reaction mixture was then heated with stirring on a steam bath for 1 hour. After being cooled with water, the resulting crystal was filtered off and then washed with acetonitrile.

The crystal thus obtained was purified by the use of methanol and chloroform and then dried under reduced pressure for 10 hours. Yield: 1.0 g (77%); m.p. 290°-291° C.

SYNTHESIS EXAMPLE 12

Synthesis of 3-[2-(2,5-diketopyrrolidyl)ethyl]-2-methylthiothiazolinium bromide 6.6 g ($5\times10^{-2}$ mols) of 2-methylthiothiazoline and 12.0 g ($6\times10^{-2}$ mols) of 2-(2,5-diketopyrrolidyl)ethyl bromide were heated with stirring for about 3 hours on an oil bath which had been heated to a temperature of 130° C. Thereafter, the reaction system was allowed to cool to room temperature. 50 ml of acetone was added to the reaction system. The resulting precipitate was recovered by decantation. 11.1 g of the desired product was obtained in a 66% yield.

3.4 g ($1\times10^{-2}$ mols) of 3-[2-(2,5-dithiopyrrolidyl)ethyl]-2-methylthiothiazolinium bromide and 1.6 g ($1\times10^{-2}$ mols) of 3-ethylrhodanine were dispersed into 50 ml of acetonitrile. The dispersion was refluxed with stirring. 3 g ($3\times10^{-2}$ mols) of triethylamine was added dropwise to the reaction system for about 5 minutes. The admixture was then refluxed with stirring for 1 hour. The reaction system was cooled with ice. The resulting crystal was filtered off, washed with 50 ml of acetonitrile, and dissolved in 100 ml of methanol and 100 ml of chloroform. The solution thus obtained was concentrated at atmospheric pressure until the volume thereof reached about 50 ml. The solution thus concentrated was cooled with ice. The resulting crystal was filtered off and washed with 20 ml of methanol.

2.5 of the desired product ($\lambda_{max}$(methanol): 396 nm) was obtained in a 72% yield.

SYNTHESIS EXAMPLE 13

Synthesis of Compound 66

5.9 g ($1\times10^{-2}$ mols) of 3-[2-(o-benzosulfimido)ethyl]-5-methoxy-2-methylthiobenzothiazoliumtoluenesulfonate and 1.9 g ($1\times10^{-2}$ mols) of 3-carboxymethylrhodanine were dispersed into 50 ml of acetonitrile. The dispersion was refluxed with stirring. 3 g ($3\times10^{-2}$ mols) of triethylamine was added dropwise to the reaction system for about 5 minutes. The reaction system was then refluxed with stirring for 1 hour. The reaction system was cooled with ice. The resulting crystal was filtered off and washed with 50 ml of acetonitrile. The crystal thus obtained was dissolved in 100 ml of methanol and 100 ml of chloroform. The solution was concentrated at atmospheric pressure until the volume thereof reached about 50 ml. The solution thus concentrated was cooled with ice. The resulting crystal was filtered off and then washed with 20 ml of methanol.

2.6 g of the desired product ($\lambda_{max}$(methanol): 436 nm) was obtained in a 47% yield.

SYNTHESIS EXAMPLE 14

Synthesis of Compound 68

3.0 g ($1\times10^{-2}$ mols) of 5-(N-acetylanilinomethylidene)-3-ethylrhodanine and 3.2 g ($1\times10^{-2}$ mols) of 3-[3-(2,5-diketopyrrolidyl)propyl]-2-methylthiazolium bromide were dispersed into 50 ml of methanol. The dispersion was refluxed with stirring. 2 g ($2\times10^{-2}$ mols) of triethylamine was added dropwise to the reaction system. The reaction system was refluxed for about 1 hour. The reaction system was cooled with ice. The resulting reaction product was put into 300 ml of diethyl ether. The resulting precipitate was recovered by decantation. The precipitate thus obtained was dissolved in 50 ml of chloroform. The solution thus obtained was filtered. 50 ml of isopropanol was added to the filtrate. The solution was concentrated at atmospheric pressure until the volume thereof was reduced by about 50 ml. The solution thus concentrated was cooled with ice. The resulting crystal was filtered off and then washed with 20 ml of isopropanol.

2.3 g of the desired product ($\lambda_{max}$(methanol): 441 nm) was obtained in a 56% yield.

SYNTHESIS EXAMPLE 15

Synthesis of Compound 69

3.3 g ($1\times10^{-2}$ mols) of 5-[3-(N-acetylanilino)-2-propenilidene]-3-ethylrhodanine and 3.2 g ($1\times10^{-2}$ mols) of 3-[3-(2,5-diketopyrrolidyl)propyl]-2-methylthiazolium bromide were dissolved in 50 ml of DMSO (dimethyl sulfoxide). The dispersion was stirred on a water bath which had been heated to a temperature of 50° C. 3 g ($2\times10^{-2}$ moles) of DBU (1,8-diazabicyclo[5,4,0]-7-undecene) was added dropwise to the reaction system for 5 minutes. The admixture was heated with stirring for about 1 hour. Thereafter, the reaction mixture was put into 300 ml of diethyl ether. The resulting precipitate was recovered by decantation.

The precipitate was dissolved in 50 ml of chloroform. The solution was then filtered. 50 ml of ethanol was added to the filtrate. The solution was then concentrated at atmospheric pressure until the volume thereof reached about 50 ml. The solution thus concentrated was filtered off and then washed with 20 ml of isopropanol.

1.44 g of the desired product ($\lambda_{max}$(methanol): 612 nm) was obtained in a 33% yield.

These sensitizing dyes can be employed individually, and can also be employed in combinations thereof. A combination of sensitizing dyes is often used, particularly for the purpose of supersensitization.

The sensitizing dyes may be present in the emulsion together with dyes which themselves do not give rise to spectrally sensitizing effects but which exhibit a supersensitizing effect or materials which do not substantially absorb visible light but which exhibit a supersensitizing effect. For example, aminostilbene compounds substituted with a nitrogen-containing heterocyclic group (for example, those described in U.S. Pat. Nos. 2,993,390 and 3,635,721, etc.), aromatic organic acid-formaldehyde condensates (for example, those described in U.S. Pat. No. 3,743,510, etc.), cadmium salts, azaindene compounds, etc., can be present. The combinations as described in U.S. Pat. Nos. 3,615,613, 3,615,641, 3,617,295 and 3,635,721 are particularly useful.

In order to incorporate the sensitizing dye into a silver halide photographic emulsion, it may be directly dispersed in the silver halide emulsion or it may be dissolved in a solvent such as water, methanol, ethanol, acetone, methyl cellosolve, etc., individually or as a mixture thereof, and then the solution is added to the silver halide emulsion. Further, the sensitizing dye is dissolved in a solvent which is substantially immiscible with water such as phenoxyethanol, etc., the solution is then dispersed in water or a hydrophilic colloid and thereafter the dispersion is added to the silver halide emulsion. Mroeover, the sensitizing dye is mixed with an oleophilic compound such as a dye providing compound, etc., and added simultaneously to the silver halide emulsion.

In the case of using a combination of the sensitizing dyes, these sensitizing dyes may be separately dissolved or a mixture thereof may be dissolved. Furthermore, these sensitizing dyes may be added separately or simultaneously as a mixture to the silver halide emulsion. They may be added together with other additives to the emulsion.

The period for the addition of the sensitizing dye to the silver halide emulsion may be before, during, or after the chemical ripening, or before, during or after the formation of silver halide grains as described in U.S. Pat. Nos. 4,183,756 and 4,225,666.

The amount added is generally in a range from about $10^{-8}$ mol to about $10^{-2}$ mol per mol of silver halide.

The silver halide which can be used in the present invention may include any of silver chloride, silver bromide, silver iodide, silver chlorobromide, silver chloroiodide, silver iodobromide, and silver chloroiodobromide.

A halogen composition in the the silver halide grains may be uniform, or the silver halide grains may have a multiple structure in which the composition is different between a surface portion and an inner portion (see Japanese Patent Application (OPI) Nos. 154232/82, 108533/83, 48755/84 and 52237/84, U.S. Pat. No. 4,433,048 and European Patent 100,984, etc.).

Also, a tabular grain silver halide emulsion containing grains having a thickness of 0.5 μm or less, a diameter of at least 0.6 m and an average aspect ratio of 5 or more (see U.S. Pat. Nos. 4,414,310 and 4,435,499, and West German Patent Application (OLS) No. 3,241,646A1, etc.), and a monodispersed emulsion having a nearly uniform distribution of grain size (see Japanese Patent Application (OPI) Nos. 178235/82, 100846/83 and 14829/83, PCT Application (OPI) No. 83/02338A1, and European Patents 64,412A3 and 83,377A1, etc.) may be used in the present invention.

Two or more kinds of silver halides in which a crystal habit, a halogen composition, a grain size and/or a distribution of grain size, etc. are different from each other may be used in mixture. Further, two or more kinds of monodispersed emulsions having different grain size from each other may be employed in mixture to control gradation.

An average grain size of the silver halide used in the present invention is preferably from 0.001 μm to 10 μm, and more preferably from 0.001 μm to 5 μm.

These silver halide emulsions can be prepared by any of an acid process, a neutral process, an an ammonia process. Further, a reaction system of soluble silver salts and soluble halogen salts may be any of a single jet process, a double jet process and a combination thereof. In addition, a reverse mixing process in which silver halide grains are formed in the presence of an excess of silver ions, or a controlled double jet process in which the pAg in the liquid phase is kept constant, can also be utilized.

Moreover, for the purpose of increasing growth of grains, a concentration of addition, the amount of addition and/or speed of addition of silver salts and halogen salts added may be raised (see Japanese Patent Application (OPI) Nos. 142329/80 and 158124/80, and U.S. Pat. No. 3,650,757, etc.).

Furthermore, silver halide grains of epitaxial junction type (see Japanese Patent Application (OPI) No. 16124/81, and U.S. Pat. No. 4,094,684, etc.) may be employed.

In the step for formation of silver halide grains used in the present invention, ammonia, an organic thioether derivative as described in Japanese Patent Publication No. 11386/72, or a compound containing sulfur as described in Japanese Patent Application (OPI) No. 144319/78, etc., can be used as a solvent for silver halide.

In a process of the formation or physical ripening of silver halide grains, a cadmium salt, a zinc salt, a lead salt, or a thallium salt, etc., may coexist. These salts are used for the purposes of improving a change in photographic performance against the pressure, etc. Further, for the purpose of eliminating high-intensity reciprocity failure or low-intensity reciprocity failure, a water-soluble iridium salt such as iridium (III or IV) chloride, ammonium hexachloroiridiate, etc. or a water-soluble rhodium salt such as rhodium chloride, etc., can be used.

Soluble salts may be removed from the silver halide emulsion after precipitate formation or physical ripening, and a noodle washing process or a flocculation process can be used for this purpose.

While the silver halide emulsion may be employed without being subjected to after-ripening, it is usually chemically sensitized. For the chemical sensitization, a sulfur sensitization method, a reduction sensitization method, and a noble metal sensitization method, etc., which are known in the field of emulsions for conventional type photographic light-sensitive materials can be applied alone or in combination therewith. Such a chemical sensitization may be carried out in the presence of a nitrogen-containing heterocyclic compound (see Japanese Patent Application (OPI) Nos. 126526/83 and 215644/83, etc.).

The silver halide emulsion used in the present invention can be that of a surface latent image type in which a latent image is formed mainly on the surface of grains, or that of an internal latent image type in which a latent image is formed mainly in the interior of grains. Further, a direct reversal emulsion in which an internal latent image type emulsion and a nucleating agent are used in combination may be used. Examples of the internal latent image type emulsions suitable for this purpose are described in U.S. Pat. Nos. 2,592,250 and 3,761,276, Japanese Patent Publication No. 3534/83, and Japanese Patent Application (OPI) No. 136641/82, etc. Preferred examples of the nucleating agents suitably used in the present invention are described in U.S. Pat. Nos. 3,227,552, 4,245,037, 4,255,511, 4,266,031 and 4,276,364, and West German Patent Application (OLS) No. 2,635,316, etc.

The coating amount of the light-sensitive silver halide used in the present invention is generally in a range of from 1 mg/m$^2$ to 10 g/m$^2$, calculated as an amount of silver.

In the present invention, an organic metal salt which is relatively stable to light is used as an oxidizing agent together with the light-sensitive silver halide. In this case, it is necessary that the light-sensitive silver halide and the organic metal salt are present in a contact state or in a close relation. Of these organic metal salts, an organic silver salt is particularly preferably used.

The organic metal salt is effective, when the heat-developable light-sensitive material is developed by heating at a temperature of 50° C. or more, and preferably 60° C. or more.

Examples of organic compounds which can be used for forming the above-described organic silver salt oxidizing agent include an aliphatic or aromatic carboxylic acid, a compound containing a mercapto group or a thiocarbonyl group having an α-hydrogen atom, and a compound containing an imino group, etc.

Typical examples of the silver salts of aliphatic carboxylic acids include a silver salt derived from behenic acid, stearic acid, oleic acid, lauric acid, capric acid, myristic acid, palmitic acid, maleic acid, fumaric acid, tartaric acid, Freund's acid, linolic acid, linoleic acid, adipic acid, sebacic acid, succinic acid, acetic acid, butyric acid, propiolic acid, and camphoric acid. Also, a silver salt derived from such an aliphatic carboxylic acid substituted with a halogen atom or a hydroxyl group, or an aliphatic carboxylic acid having a thioether group, etc., can be used.

Typical examples of the silver salts of aromatic carboxylic acids and other carboxyl group-containing compounds include a silver salt derived from benzoic acid, 3,5-dihydroxybenzoic acid, o-methylbenzoic acid, m-methylbenzoic acid, p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid, and 3-carboxymethyl-4-methyl-4-thiazolin-2-thione, etc.

Examples of the silver salts of compounds containing a mercapto group or a thiocarbonyl group include a silver salt derived from 3-mercapto-4-phenyl-1,2,4-triazole, 2-mercaptobenzimidazole, 2-mercapto-5-aminothiadiazole, 2-mercaptobenzothiazole, an S-alkyl thioglycolic acid (wherein the alkyl group has from 12 to 22 carbon atoms), a dithiocarboxylic acid such as dithioacetic acid, etc., a thioamide such as thiostearoylamide, etc., 5-carboxyl-1-methyl-2-phenyl-4-thiopyridine, and a mercapto compound such as mercaptotriazine, 2-mercaptobenzoxazole, or mercaptooxadiazole, etc., as described in U.S. Pat. No. 4,123,274, etc.

Typical examples of the silver salts of compounds containing an imino group include a silver salt derived from a benzotriazole or a derivative thereof as described in Japanese Patent Publication Nos. 30270/69 and 18416/70, for example, benzotriazole, an alkyl-substituted benzotriazole such as methylbenzotriazole, etc., a halogen-substituted benzotriazole such as 5-chlorobenzotriazole, etc., a carboimidobenzotriazole such as butylcarboimidobenzotriazole, etc., a nitrobenzotriazole as described in Japanese Patent Application (OPI) No. 118639/83, sulfobenzotriazole, carboxybenzotriazole or a salt thereof, hydroxybenzotriazole, etc., as described in Japanese Patent Application (OPI) No. 118638/83, a 1,2,4-triazole or a 1H-tetrazole as described in U.S. Pat. No. 4,220,709, a carbazole, a saccharin, an imidazole and a derivative thereof, etc.

Moreover, a silver salt as described in *Research Disclosure,* RD No. 17029 (June, 1978), an organic metal salt other than a silver salt, such as copper stearate, etc., and a silver salt of a carboxylic acid which is heat decomposable such as phenylpropiolic acid, etc. as described in Japanese Patent Application No. 221535/83 are also used in the present invention.

The organic silver salt and organic metal salt described above can be employed in a range from 0.01 mol to 10 mols and preferably from 0.01 mol to 1 mol, per mol of the light-sensitive silver halide. The total coating amount of the light-sensitive silver halide and the organic silver salt and organic metal salt is suitably from 50 mg/m$^2$ to 10 g/m$^2$.

The presence of a base and/or base precursor in the present invention is desired in that it improves the heat fading of the sensitizing dye. The amount of the base and/or base precursor to be used may be widely selected and generally is about 50% by weight or less, more preferably in the range of from 0.01 to 40% by weight based on the weight of the coated film.

Examples of preferred bases include an inorganic base, for example, a hydroxide, a secondary or tertiary phosphate, a borate, a carbonate, a quinolinate or a metaborate of an alkali metal or an alkaline earth metal, ammonium hydroxide, a hydroxide of a quaternary alkylammonium, a hydroxide of other metals, etc., and an organic base, for example, an aliphatic amine (such as a trialkylamine, a hydroxylamine, an aliphatic polyamine, etc.), an aromatic amine (such as an N-alkyl substituted aromatic amine, an N-hydroxyalkyl substituted aromatic amine, a bis[p-(dialkylamino)phenyl]methane, etc.), a heterocyclic amine, an amidine, a cyclic amidine, a quanidine, a cyclic quanidine, etc. Among them, those having pKa of 8 or more are particularly preferred.

Also, a salt of the above described organic base and a weak acid, for example, a carbonate, a hydrogen carbonate, a borate, a secondary or tertiary phosphate, a quinolinate, a metaborate, etc., is preferably used. Furthermore, the compounds as described in Japanese Patent Application (OPI) No. 218443/84 are preferably employed.

As a base precursor, a substance which releases a base upon a reaction by heating, for example, a salt of an organic acid and a base which decomposes by heating with decarboxylation, a compound which releases an amine upon decomposition with an intramolecular nucleophilic displacement reaction, a Lossen rearrangement reaction or a Beckmann rearrangement reaction, etc., or a compound which generates a base by electrolysis, etc., are preferably employed.

Examples of preferred former type base precursors which release a base by heating include a salt of trichloroacetic acid as described in British Patent 998,949, etc., a salt of α-sulfonylacetic acid as described in U.S. Pat. No. 4,060,420, a salt of a propiolic acid as described in Japanese Patent Application (OPI) No. 180537/84, a 2-carboxycarboxamide derivative as described in U.S. Pat. No. 4,088,496, a salt of a thermally decomposable acid using, in addition to an organic base, an alkali metal or an alkaline earth metal as a base component as described in Japanese Patent Application (OPI) No. 195237/84, a hydroxamecarbamate utilizing a Lossen rearrangement as described in Japanese Patent Application (OPI) No. 168440/84, an aldoximecarbamate which forms a nitrile upon heating as described in Japanese Patent Application (OPI) No. 157637/84, etc. Further, base precursors as described in British Patent 998,945, U.S. Pat. No. 3,220,846, Japanese Patent Application (OPI) No. 22625/75, and British Patent 2,079,480, etc., are useful.

Examples of compounds which generate a base by electrolysis using electrolytic oxidation include various salts of fatty acids. According to such a reaction, carbonates of alkali metals or organic bases such as a quanidine, an amidine, etc., can be obtained in extremely high efficiency.

Further, methods using electrolytic reduction include a method for forming an amine by reduction of a nitro or nitroso compound; a method for forming an amino by reduction of nitrile; a method for forming a p-aminophenol, a p-phenylenediamine, a hydrazine, etc., by reduction of a nitro compound, an azo compound, an azoxy compound, etc.; or the like. The p-aminophenols, p-phenylenediamines, and hydrazines can be employed not only as bases but also directly as color image forming substances.

Moreover, it is naturally utilized that alkali components are generated by electrolysis of water in the presence of various inorganic salts.

In the present invention, silver may be used as an image-forming substance. Alternatively, a compound which produces or releases a mobile dye in response to or counter-response to the reduction of light-sensitive silver halides to silver at an elevated temperature, i.e., dye providing substances, may be used as a image-forming substance.

An example of the dye providing substance which can be used in the present invention is a coupler capable of reacting with a developing agent (reducing agent). A method utilizing such a coupler can form a dye upon a reaction of the coupler with an oxidation product of a developing agent which is formed by an oxidation reduction reaction between the silver salt and the developing agent and is described in many literatures. Specific examples of the developing agents and the couplers are described in greater detail, for example, in T. H. James, *The Theory of the Photographic Process,* Fourth Edition, pp. 291 to 334 and pp. 354 to 361, MacMillan Publishing Co., 1977; Shinichi Kikuchi, *Shashin Kagaku* (Photographic Chemistry), Fourth Edition, pp. 284 to 295, Kyoritsu Shuppan Co., Ltd., 1977.

Another example of the dye providing substance is a dye-silver compound in which an organic silver salt is connected to a dye. Specific examples of the dye-silver compounds are described in *Research Disclosure,* RD No. 16966, pp. 54 to 58 (May, 1978), etc.

Still another example of the dye providing substance is an azo dye used in a heat-developable silver dye bleaching process. Specific examples of the azo dyes and the method for bleaching are described in U.S. Pat. No. 4,235,957, *Research Disclosure, No.* 14433, pp. 30 to 32 (April, 1976), etc.

A further example of the dye providing substance is a leuco dye as described in U.S. Pat. Nos. 3,985,565 and 4,022,617, etc.

A still further example of the dye providing substance is a compound having a function of imagewise releasing a diffusible dye.

This type of compound can be represented by formula (LI)

$$(\text{Dye-X})_n\text{-Y} \qquad \text{(LI)}$$

wherein Dye represents a dye moiety or a dye precursor moiety; X represents a chemical bond or a connecting group; Y represents a group having a property such that diffusibilty of the compound represented by $(\text{Dye-X})_n$-Y can be differentiated in correspondence or countercorrespondence to light-sensitive silver salts having a latent image distributed imagewise or a group having a property of releasing Dye in correspndence or countercorrespondence to light-sensitive silver salts having a latent image distributed imagewise, diffusibility of Dye released being different from that of the compound represented by $(\text{Dye-X})_n$-Y; and n represents 1 or 2 and when n is 2, the two Dye-X groups are the same or different.

Specific example of the dye providing substance represented by formula (LI) include, for example, dye developers in which a hydroquinone type developing agent (reducing agent) is connected to a dye component are described in U.S. Pat. Nos. 3,134,764, 3,362,819, 3,597,200, 3,544,545 and 3,482,972, etc. Further, substances capable of releasing diffusible dyes upon an intramolecular nucleophilic displacement reaction are described in Japanese Patent Application (OPI) No. 63618/76, etc., and substances capable of releasing diffusible dyes upon an intramolecular rearrangement reaction of an isooxazolone ring are described in Japanese Patent Application (OPI) No. 111628/74, etc.

In any of these processes, diffusible dyes are released in portions where development does not occur. In contrast, in portions where development occurs neither release nor diffusion of dyes take place.

There has been provided a process in which a dye releasing compound is preliminarily converted to an oxidized form thereof which does not have a dye releasing abilility, the oxidized form of the compound is coexistent with a reducing agent or a precursor thereof, and after development the oxidized form is reduced with the remaining reducing agent which is not oxidized to release a diffusible dye. Specific examles of dye providing substances which can be used in such a process are described in Japanese Patent Application (OPI) Nos. 110827/78, 130927/79, 164342/81, and 35533/78, etc.

On the other hand, substances capable of releasing diffusible dyes in portions where development occurred are also know. For example, substances capable of releasing diffusible dyes in the releasing groups thereof with oxidation products of developing agents (reducing agents) are described in British Patent No. 1,330,524, Japanese Patent Publication No. 39165/73, U.S. Pat. No. 3,443,940, etc., and substances capable of forming diffusible dyes upon a reaction of couplers having diffusion resistant groups in the releasing groups thereof with oxidation products of developing agents are described in U.S. Pat. No. 3,227,550, etc.

In these processes using color developing agents, there is a severe problem in that images are contaminated with oxidation decomposition products of the developing agents. Therefore, in order to eliminate such a problem, dye releasing compounds which have reducing property themselves and thus do not need the use of developing agents have been proposed. (As a matter of course, the above-described reducing agents may be auxiliary used.) Typical examples of these dye releasing compounds are illustrated together with the relevant literatures in the following. The definitions for the substituents of the general formula set forth below are the same as those described in the cited literatures, respectively.

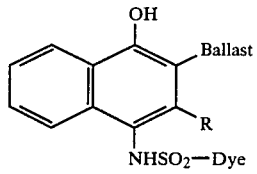

U.S. Pat. No. 3,928,312, etc.

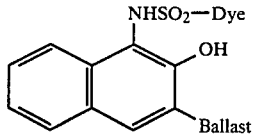

U.S. Pat. No. 4,053,312, etc.

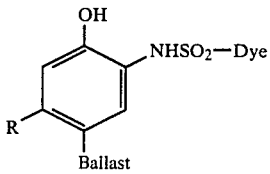

U.S. Pat. No. 4,055,428, etc.

-continued

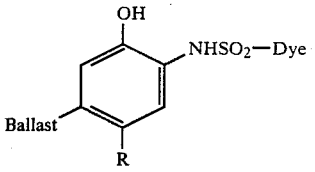

U.S. Pat. No. 4,336,322

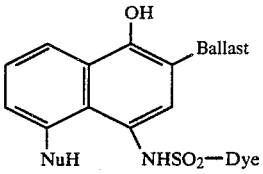

Japanese Patent Application (OPI) No. 65839/84

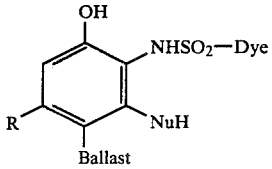

Japanese Patent Application (OPI) No. 65839/84

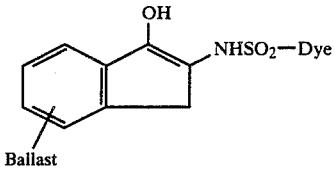

U.S. Pat. No. 4,149,892

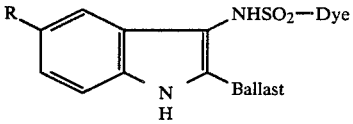

U.S. Pat. No. 4,198,235

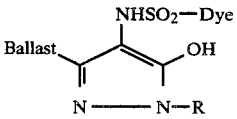

U.S. Pat. No. 4,198,235

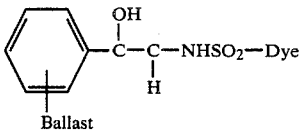

U.S. Pat. No. 4,198,235

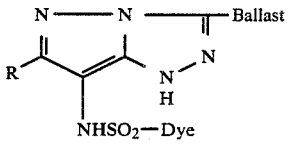

Research Disclosure, RD No. 17465 (Oct., 1978)

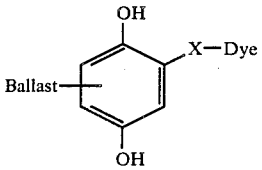

U.S. Pat. No. 3,725,062

-continued

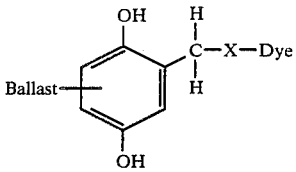

U.S. Pat. No. 3,728,113

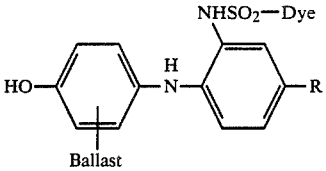

U.S. Pat. No. 3,443,939

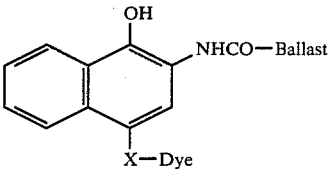

Japanese Patent Application (OPI) No. 116537/78

The dye moiety represented by Dye in the above described formula is preferably derived from azo dyes, azomethine dyes, anthraquinone dyes, naphthoquinone dyes, styryl dyes, nitro dyes, quinoline dyes, carbonyl dyes, and phthalocyanine dyes. Further, the dye moiety may be used in a form temporarily shifted to a shorter wavelength region or in the form of a precursor. Specific examples of the dye moieties released from the dye providing compounds include those described in the above-mentioned U.S. Pat. No. 4,473,631, and the chelated dyes as described in Japanese Patent Application (OPI) No. 35533/78.

Any of various dye providing substances described above can be employed in the present invention.

Specific examples of image forming substances used in the present invention are described in the patents and literature mentioned hereinbefore.

The dye providing substance and oil soluble additives such as the image forming accelerator described below, etc., used in the present invention can be introduced into a layer of the light-sensitive material by known methods, such as the method as described in U.S. Pat. No. 2,322,027. In this case, an organic solvent having a high boiling point or an organic solvent having a low boiling point as described below can be used. For example, the dye providing substance, etc., is dispersed in a hydrophilic colloid after being dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, diotylbutyl phosphate, etc.), a citric acid ester (for example, tributyl acetylcitrate, etc.), a benzoic acid ester (for example, octyl benzoate, etc.), an alkylamide, a fatty acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetage, etc., ethyl propionate, secondary butyl alcohol, methyl isobutyl ketone, α-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance, etc. is dispersed in a hydrophilic colloid. For this purpose, the surface active agents illustrated in other part of the specification can be used.

An amount of the organic solvent having a high boiling point used in the present invention is 10 g or less, and preferably 5 g of less, per g of the dye providing substance used.

In case of using compounds which are substantially water-insoluble, they may be incorporated in the light-sensitive material by dispersing as fine particles in a binder, in addition to the above described methods.

In the present invention, the light-sensitive material preferably also contains a reducing substance. Reducing substances which have been previously described as dye providing substances having a reducing power may be used, as well as those compounds commonly known as reducing agents. Other reducing agents include a reducing agent precursor which has no reducing property itself but exhibits a reducing property due to action by a nucleophilic reagent or heat in the development process.

Examples of the reducing agents which can be used in the present invention include an inorganic reducing agent such as sodium sulfite, sodium hydrogen sulfite, etc., a benzenesulfonic acid, a hydroxylamine, a hydrazine, a hydrazide, a boran-amine complex, a hydroquinone, an aminophenol, a catechol, a p-phenylenediamine, a 3-pyrazolidinone, a hydroxytetronic acid, an ascorbic acid, a 4-amino-5-pyrazolone, etc. The reducing agents as described in T. H. James, *The Theory of the Photographic Process,* Fourth Edition, pp. 291 to 334 (1977) can also employed. Further, reducing agent precursors as described in Japanese Patent Application (OPI) No. 138736/81 and 40245/82, U.S. Pat. No. 4,330,617, etc., may be employed.

Various combinations of developing agents as described in U.S. Pat. No. 3,039,869 can also be used.

In the present invention, an amount of the reducing agent added is from 0.01 mol to 20 mols per mol of silver, and more preferably from 0.01 mol to 10 mols, per mol of silver.

In the present invention, an image formation accelerator can be used. The image formation accelerator has a function which accelerates the oxidation reduction reaction between a silver salt oxidizing agent and a reducing agent, a function which accelerates a reaction of forming a dye, decomposing a dye or releasing a mobile dye from a dye providing substance, etc., or a function which accelerates transfer for a dye from a layer of the light-sensitive material to a dye fixing layer. From the standpoint of a physical or chemical function, they are classified into a group, for example, a base or base precursor, a nucleophilic compound, an oil, a thermal solvent, a surface active agent, a compound having an interaction with silver or a silver ion, etc. However, such groups of substances usually show complex functions and generally show several some of the above described accelerating effects at the same time.

The image formation accelerators other than bases and base precursors are classified depending on their function and specific examples thereof are set forth below. However, such a classification is only for convenience, and, as noted above, in practice a compound may often have multiple function.

(a) Nucleophilic compound

Examples of the nucleophilic compounds include water, a water releasing compound, an amine, an amidine, a quanidine, a hydroxylamine, a hydrazine, a hydrazide, an oxime, a hydroxamic acid, a sulfonamide, an active methylene compound, an alcohol, a thiol, etc. Further, salts or precursors of the above described compounds may be employed.

(b) Oil

An organic solvent having a high boiling point (so-called plasticizer) which can be used as a solvent for dispersion of a hydrophobic compound is employed.

(c) Thermal solvent

The thermal solvent is a compound which is solid at an ambient temperature, but melts at a desired development temperature to act as a solvent. Examples of the thermal solvents include compounds which are selected from a urea, a urethane, an amide, a pyridine, a sulfonamide, a sulfone, a sulfoxide, an ester, a ketone and an ether and which are solid at 40° C. or below.

(d) Surface active agent

Examples of the surface active agents include a pyridinium salt, an ammonium salt, and a phosphonium salt as described in Japanese Patent Application (OPI) No. 74547/84, etc., and a polyalkylene oxide as described in Japanese Patent Application (OPI) No. 57231/84, etc.

(e) Compound having an interaction with silver or a silver ion

Examples of such compounds include an imide, a nitrogen-containing heterocyclic compound as described in Japanese Patent Application (OPI) No. 177550/84, a thiol, a thiourea, and a thioether as described in Japanese Patent Application (OPI) No. 111636/84, etc.

The image formation accelerator may be incorporated in either a light-sensitive material or a dye fixing material, or both of them. Further, it may be incorporated into any of an emulsion layer, an intermediate layer, a protective layer, an image receiving layer (a dye fixing layer) and a layer adjacent thereto. The above descriptions are true in an embodiment wherein a light-sensitive layer and a dye fixing layer are provided on the same support.

The image formation accelerators may be employed individually or in a mixture of two or more thereof. In general, a great accelerating effect is obtained when two or more kinds thereof are employed in mixture. Particularly, when a base or base precursor is employed together with other kinds of the accelerators, a remarkable accelerating effect is revealed.

In the present invention, various kinds of development stopping agents are used for the purpose of obtaining a constant image irrespective of variation in a processing temperature and a processing time at the development.

The term "development stopping agent" used herein means a compound which can rapidly neutralize a base or react with a base to decrease concentration of the base in the layer when the development has appropriately proceeded whereby the development is stopped or a compound which can interact with silver or a silver salt and inhibit the development.

Examples of the development stopping agents include an acid precursor which releases an acid by heating, an electrophilic compound which causes a displacement reaction with a base coexistent by heating, a nitrogen-containing heterocyclic compound, a mercapto compound, and a precursor thereof, etc.

Examples of the acid precursors include an oxime ester as described in Japanese Patent Application (OPI) Nos. 108837/85 and 192939/85, a compound which releases an acid upon a Lossen rearrangement as described in Japanese Patent Application (OPI) No. 230133/85, etc.

Examples of the electrophilic compounds which cause a displacement reaction with bases by heating include a compound as described in Japanese Patent Application (OPI) No. 230134/85, etc.

Further, the compounds which release a mercapto compound by heating are useful and include those described in U.S. patent application Ser. Nos. 774,427 (filed Sept. 10, 1985), 809,627 (filed Dec. 16, 1985), 799,996 (filed Nov. 20, 1985), 827,139 (filed Feb. 7, 1986), 829,032 (filed Feb. 13, 1986), 828,481 (filed Feb. 12, 1986) and 830,031 (filed Feb. 18, 1986), Japanese Patent Application (OPI) No. 53632/86, etc.

It is preferred that the above described development stopping agent is employed together with the base precursor since its effect is particularly achieved.

In such a case, the ratio (molar ratio) of base precursor/acid precursor is preferably in a range from 1/20 to 20/1, and more preferably in a range of 1/5 to 5/1.

Further, in the present invention, it is possible to use a compound which activates development simultaneously while stabilizing the image. Particularly, it is preferred to use an isothiuronium including 2-hydroxyethylisothiuronium trichloroacetate, etc., as described in U.S. Pat. No. 3,301,678, a bis(isothiuronium) including 1,8-(3,6-dioxaoctane)bis(isothiuronium trichloroacetate), etc., as described in U.S. Pat. No. 3,669,670, a thiol compound as described in West German Patent Application (OLS) No. 2,162,714, a thiazolium compound such as 2-amino-2-thiazolium tricholoracetate, 2-amino-5-bromoethyl-2-thiazolium trichloracetate, etc., as described in U.S. Pat. No. 4,012,260, a compound having an $\alpha$-sulfonylacetate as an acidic component, such as bis(2-amino-2-thiazolium)methylenebis(-sulfonylacetate), 2-amino-2-thiazolium phenylsulfonylacetate, etc., as described in U.S. Pat. No. 4,060,420, etc.

Moreover, an azole thioether and a blocked azolinethione compound as described in Belgian Patent No. 768,071, a 4-aryl-1-carbomyl-2-tetrazolin-5-thione compound as described in U.S. Pat. No. 3,893,859, and a compound as described in U.S. Pat. Nos. 3,839,041, 3,844,788 and 3,877,940 are also preferably employed.

In the present invention, various kinds of antifogging agents can be employed. Examples of useful antifogging agents include an azole, a carboxylic acid and a phosphoric acid each containing a nitrogen atom as described in Japanese Patent Application (OPI) No. 168442/84, mercapto compound and a metal salt thereof as described in Japanese Patent Application (OPI) No. 111636/84, etc. Such an antifogging agent is generally used in a concentration range from 0.001 mol to 10 mols per mol of silver.

In the present invention, image toning agents can be incorporated, if desired. Effective toning agents are compounds such as phthaladinones, 1,2,4-triazoles, 1H-tetrazoles, thiouracils and 1,3,4-thiadiazoles, etc. Examples of preferred toning agents include 5-amino-1,3,4-thiadiazole-2-thiol, 3-mercapto-1,2,4-triazole, bis(dimethycarbamyl)disulfide, 6-methylthiouracil and 1-phenyl-2-tetrazolin-5-thione, etc. Particularly effective toning agents are compounds which can form black images.

The concentration of the toning agents incorporated varies according to the kind of heat-developable light-sensitive material, processing conditions, images to be required, and other factors, but it is generally in a range of from about 0.001 mol to 0.1 mol per mol of silver in the light-sensitive material.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, a protein such as gelatin or a gelatin derivative, a cellulose derivative, a polysaccharide such as starch, gum arabic, etc., and a synthetic polymer compound, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

In addition, the compounds as described in *Research Disclosure,* page 26, IXA (December, 1978) can be so employed.

A suitable coating amount of the binder according to the present invention is generally 20 g/m$^2$ or less, preferably 10 g/m$^2$ or less, and more preferably 7 g/m$^2$ or less.

A suitable ratio of the organic solvent having a high boiling point which is dispersed in a binder together with a hydrophobic compound such as a dye providing substances to the binder is 1 ml or less, preferably 0.5 ml or less, and more preferably 0.3 ml or less, per g of the binder.

In the heat-developable light-sensitive material and the dye fixing material according to the present invention, the photographic emulsion layer, the above described electrically conductive layer, the dye fixing layer and other binder layers may contain an inorganic or organic hardener. It is possible to use a chromium salt (e.g., chromium alum, chromium acetate, etc.), an aldehyde (e.g., formaldehyde, glyoxal, glutaraldehyde, etc.), an N-methylol compound (e.g., dimethylolurea, methylol dimethylhydantoin, etc.), a dioxane derivative (e.g., 2,3-dihydroxydioxane, etc.), an active vinyl compound (e.g., 1,3,5-triacryloylhexahydro-s-triazine, 1,3-vinylsulfonyl-2-propanol, 1,2-bis(vinylsulfonylacetamide)ethane, etc.), an active halogen compound (e.g., 2-4-chloro-6-hydroxy-1,3,5-triazine, etc.), a mucohalogenic acid (e.g., mucochloric acid, mucophenoxychloric acid, etc.), etc., which are used individually or as a combination thereof.

A support used in the heat-developable light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a resin material may be used. Further, a paper support laminated with a polymer such as polyethylene, etc., can be used. Polyesters as described in U.S. Pat. Nos. 3,634,089 and 3,725,070 are preferably used.

When the dye providing substance represented by formula (LI) described above is incorporated into the heat-developable light-sensitive material used in the present invention, since the dye providing substance is colored, it is not so necessary to further incorporate an anti-irradiation or antihalation substance or various dyes in the light-sensitive material. However, in order to increase sharpness of images, a filter dye or an absorbing substance, etc., as described in Japanese Patent Publication No. 3692/73, U.S. Pat. Nos. 3,253,921, 2,527,583 and 2,956,879, etc., can be incorporated into the light-sensitive material used in the present invention. It is preferred for such a dye to lose its color upon heating. For example, dyes as described in U.S. Pat. Nos. 3,769,019, 3,745,009 and 3,615,432, etc., are preferably employed.

The light-sensitive material which can be used in the present invention may contain, if desired, various additives which are known to use in heat-developable light-sensitive materials, and layer other than the light-sensitive layer, for example, a protective layer, an intermediate layer, an antihalation layer, a stripping layer, etc. Various additives which can be used include those as described in *Research Disclosure,* Vol. 170, RD No. 17029 (June, 1978), for example, a plasticizer, a sharpness-improving dye, an antihalation dye, a matting agent, a surface active agent, a fluorescent whitening agent, a color fading prevent agent, etc.

The photographic element according to the present invention is composed of a light-sensitive element which forms or releases a dye upon development by heating, and, if desired, a dye fixing element for fixing a dye. Particularly in a system wherein images are formed by diffusion transfer of dyes, both the light-sensitive element and the dye fixing element are essential. Typical photographic elements employed in such a system are divided broadly into two embodiments, that is, an embodiment in which the light-sensitive element and the dye fixing element are provided on two supports separately, and an embodiment in which the both elements are provided on the same support.

The embodiment in which the light-sensitive element and the dye fixing element are formed on different supports is further classified into two types. Specifically, one is a peel-apart type, and the other is a non-peel-apart type.

In the case of the peel-apart type, a coated surface of the light-sensitive element and a coated surface of the dye fixing element are superposed on each other after imagewise exposure or heat development, and then after formation of transferred images the light-sensitive element is rapidly peeled apart from the dye fixing element. A support of the dye fixing element is selected from an opaque support and a transparent support depending on the fact that whether the final image is a reflective type or a transmitting type. Further, a white reflective layer may be provided on the support, if desired.

In case of the latter non-peel-apart type, it is necessary that a white reflective layer is present between a light-sensitive layer of the light-sensitive element and a dye fixing layer of the dye fixing element. The white reflective layer can be provided in either the light-sensitive element or the dye fixing element. In this case, a support of the dye fixing element is required to be a transparent support.

One representative example of the embodiment in which the light-sensitive element and the dye fixing element are provided on the same support is a type in which the light-sensitive element is not necessary to peel apart from the image receiving element after the formation of transferred images. In such a case, on a transparent or opaque support a light-sensitive layer, a dye fixing layer and a white reflective layer are superposed. Examples of preferred embodiments of layer structure include transparent or opaque support/light-sensitive layer/white reflective layer/dye fixing layer, or transparent support/dye fixing layer/white reflective layer/light-sensitive layer, etc.

Another typical example of the embodiment in which the light-sensitive element and the dye fixing element are provided on the same support is a type in which a part or all of the light-sensitive element is separated from the dye fixing element and a stripping layer is provided on an appropriate position of the element as described, for example, in Japanese Patent Application (OPI) No. 67840/81, Canadian Patent No. 674,082, U.S. Pat. No. 3,730,718, etc.

The light-sensitive element or the dye fixing element may form a structure having an electrically conductive heat generating layer suitable for use as heating means for the purpose of heat development or diffusion transfer of dyes.

In order to reproduce a large range of color in a chromaticity diagram using three elementary colors, i.e., yellow, magenta, and cyan, it is necessary that the light-sensitive element used in the present invention contains at least three silver halide emulsion layers each having its sensitivity in a spectral region different from each other.

Typical examples of the combination of at least three silver halide emulsion layers each having its sensitivity in a sectral region different from each other include (1) a combination of a blue-sensitive emulsion layer, a green-sensitive emulsion layer, and a red-sensitive emulsion layer, (2) a combination of a green-sensitive emulsion layer, a red-sensitive emulsion layer, and an infrared light-sensitive emulsion layer, (3) a combination of a blue-sensitive emulsion layer, a green-sensitive emulsion layer, and an infrared light-sensitive emulsion layer, (4) a combination of a blue-sensitive emulsion layer, a red-sensitive emulsion layer and an infrared light-sensitive emulsion layer, etc. The reference to an infrared light-sensitive emulsion layer as used herein means an emulsion layer having a sensitivity maximum in a region of 700 nm or more particularly in a region of 740 nm or more.

The light-sensitive material used in the present invention may also have two or more light-sensitive emulsion layers which are sensitive to light of the same spectral region but have different sensitivities, if desired.

It is necessary for the production of natural color images that each of the above described emulsion layers and/or light-insensitive hydrophilic colloid layers adjacent to the emulsion layers contains at least one kind of a dye providing substance capable of releasing or forming a yellow hydrophilic dye, a dye providing substance capable of releasing or forming a magenta hydrophilic dye, and a dye providing substance capable of releasing or forming a cyan hydrophilic dye, respectively. In other words, in each of the emulsion layers and/or light-insensitive hydrophilic colloid layers adjacent to the emulsion layers, dye providing substances capable of releasing or forming hydrophilic dyes having different hues from each other should be incorporated, respectively. If desired, two or more kinds of dye providing substances having the same hue may be used in mixture. In case of using dye providing substances which are colored originally, it is particularly advantageous that the dye providing substances are incorporated into layers other than the emulsion layer.

The light-sensitive material used in the present invention may contain, if desired, a subsidiary layer, for example, a protective layer, an intermediate layer, an antistatic layer, an anti-curling layer, a stripping layer, a matting layer, etc. in addition to the above described layers.

Particularly, the protective layer (PC) usually contains an organic or inorganic matting agent for the purpose of preventing adhesion. Further, the protective layer may contain a mordant, an ultraviolet light absorbing agent, etc. The protective layer and the intermediate layer may be composed of two or more layers, respectively.

Moreover, the intermediate layer may contain a reducing agent for preventing color mixing, an ultraviolet light absorbing agent, a white pigment such as $TiO_2$, etc. The white pigment may be incorporated into the emulsion layer in addition to the intermediate layer, for the purpose of increasing the sensitivity.

In order to impart the spectral sensitivity as described above to the silver halide emulsion, the silver halide emulsion may be spectrally sensitized using the sensitizing dye of the present invention so as to obtain the desired spectral sensitivity.

The dye fixing element which can be used in the present invention comprises at least one layer containing a mordant. When the dye fixing layer is positioned on the surface of the dye fixing element, a protective layer can be further provided in the element, if desired.

A water absorbing layer or a layer containing a dye transfer assistant may be provided in order to sufficiently incorporate the dye transfer assistant, if desired, or in order to control the dye transfer assistant. These layers may be provided adjacent to the dye fixing layer or provided through an intermediate layer.

The dye fixing layer used in the present invention may be composed of two or more layers containing mordants which have mordanting powers different from each other, if desired.

The dye fixing element used in the present invention may contain, if desired, a subsidiary layer, for example, a stripping layer, a matting layer, an anti-curling layer, etc., in addition to the above described layers.

Into one or more of the layers described above, a base and/or base precursor for the purpose of accelerating dye transfer, a hydrophilic thermal solvent, a color fading preventing agent for preventing fading of dyes, an ultraviolet light absorbing agent, a dispersed vinyl compound for the purpose of increasing dimensional stability, a fluorescent whitening agent, etc. may be incorporated.

The binder which can be used in the above described layers is preferably a hydrophilic binder. The typical hydrophilic binder is a transparent or translucent hydrophilic colloid, examples of which include a natural substance, for example, a protein such as gelatin, a gelatin derivative, polyvinyl alcohol, a cellulose derivative, etc., a polyaccharide such as starch, gum arabic, etc., and a synthetic polymer compound, for example, dextrin, pullulan, a water-soluble polyvinyl compound such a polyvinyl alcohol, polyvinyl pyrrolidone, acrylamide polymer, etc. Among them, gelatin and polyvinyl alcohol are particularly preferred.

The dye fixing element may have a reflective layer containing a white pigment such as titanium oxide, etc., a neutralizing layer, a neutralization timing layer, etc., in addition to the above described layer depending on the purposes. These layers may be provided not only in the dye fixing element, but also in the light-sensitive element. The compositions of these reflective layer, neutralizing layer, and neutralization timing layer are decribed, for example, in U.S. Pat. Nos. 2,983,606, 3,362,819, 3,362,821 and 3,415,644, Canadian Patent No. 928,559, etc.

It is advantageous that the dye fixing element according to the present invention contains a transfer assistant as described below. The transfer assistant may be incorporated into the above described dye fixing layer or another layer.

The dye fixing layer employed in the present invention includes a dye fixing layer which can be used in heat-developable color light-sensitive materials. A mordant to be used can be selected appropriately from mordants conventionally used. Among them, polymeric mordants are particularly preferred. The polymeric mordants include polymers containing tertiary amino groups, polymers containing nitrogen-containing heterocyclic moieties, and polymers containing quaternary cationic groups thereof, etc.

Specific examples of polymers containing vinyl monomer units having a tertiary amino group are described in Japanese Patent Application (OPI) Nos. 60643/85 and 57836/85, etc. Specific examples of polymers containing vinyl monomer units having a tertiary imidazole group are described in Japanese Patent Application (OPI) Nos. 118834/85 and 122941/85, U.S. Pat. Nos. 4,282,305, 4,115,124 and 3,148,061, etc.

Specific examples of preferred polymers containing vinyl monomer units having a quaternary imidazolium salt are described in British Pat. Nos. 2,056,101, 2,093,041 and 1,594,961, U.S. Pat. Nos. 4,124,386, 4,115,124, 4,273,853 and 4,450,224, Japanese Patent Application (OPI) No. 28225/73, etc.

Specific examples of other preferred polymers containing vinyl monomer units having a quaternary ammonium salt are described in U.S. Pat. Nos. 3,709,690, 3,898,088, and 3,958,995, Japanese Patent Application (OPI) Nos. 57836/85, 60643/85, 122940/85, 122942/85 and 235134/85, etc.

In the present invention, a transparent or opaque heat generating element used in the case of adopting current heating as a means for development can be prepared utilizing heretofore known techniques with respect to a resistance heat generator.

The resistance heat generator includes a method utilizing a thin layer of an inorganic material exhibiting semiconductor properties, and a method utilizing a thin layer of an organic material composed of electrically conductive fine particles dispersed in a binder. The materials which can be employed in the former method include silicon carbide, molybdenum silicide, lanthanum chromate, barium titanate ceramics used as a PTC thermistor, tin oxide, zinc oxide, etc. These materials can be used to prepare a transparent or opaque thin layer in a known manner. With the latter method, electrically conductive fine particles such as metallic fine particles, carbon black, graphite, etc., are dispersed in a binder such as rubber, a synthetic polymer, gelatin, etc., to prepare a resistor having a desired temperature characteristic. The resistor may be either directly brought into contact with the light-sensitive element or separated by a support or an intermediate layer, etc.

The relationship of positions of the heat generating element and the light-sensitive element are illustrated below.

Heat generating element/support/light-sensitive element

Support/heat generating element/light-sensitive element

Support/heat generating element/intermediate layer/light-sensitive element

Support/light-sensitive element/heat generating element

Support/light-sensitive element/intermediate layer/-heat generating element

A protective layer, an intermediate layer, a subbing layer, a back layer and other layers can be produced by preparing each coating solution and applying it to a support by various coating methods such as a dip coating method, an air-knife coating method, a curtain coating method or a hopper coating method as described in U.S. Pat. No. 2,681,294 and drying in the same manner as used in preparing the light-sensitive layer or the dye fixing layer according to the present invention, by which the light-sensitive material is obtained.

If desired, two or more layers may be applied at the same time by the method as described in U.S. Pat. No. 2,761,791 and British Pat. No. 837,095.

As light sources of imagewise exposure in order to record images on the heat-developable light-sensitive material, radiant rays including visible light can be utilized. Generally, light sources used for conventional color prints can be used, examples of which include tungsten lamps, mercury lamps, halogen lamps such as iodine lamps, xenon lamps, laser light sources, CRT light sources, fluorescent tubes, and light emitting diodes (LED), etc.

Heating means used in development and/or the dye transfer process in the present invention include the previously mentioned heating element, as well as a heating plate, an iron, a heating roller, radiation such as infrared light, ultrasonic wave, and high frequency heating.

In the present invention, if the transfer of a mobile dye is involved, the transfer process may be conducted separately from the development process or alternatively, both the processes may be simultaneously conducted as described in Japanese Patent Application (OPI) No. 218443/84. Either process is useful.

In the present invention, if a dye providing substance which releases a mobile dye imagewise is used, a dye transfer assistant may be used for transfer of a dye from the light-sensitive layer to the dye fixing layer.

Dye transfer assistants, which are supplied from outside the element, include water, a basic aqueous solution of caustic soda, caustic potash, an inorganic alkali metal salt or an organic base. Bases which may be employed are those described above with reference to the image formation accelerators. Alternatively, a low boiling point solvent such as methanol, N-N-dimethylformamide, acetone, and diisobutyl ketone or a mixture of such solvents and water or a basic aqueous solution may be used. The dye transfer assistant may be used in such a manner that the dye fixing material, the light-sensitive material, or both these materials are wet therewith.

If the dye transfer assistant is originally incorporated in the light-sensitive material or the dye fixing material, the dye transfer assistant is not required to be supplied from outside the element. The dye transfer assistant may be incorporated in the material in the form of water of crystallization or in microcapsules, or in the form of a precursor which releases a solvent at an elevated temperature. More preferably, a hydrophilic thermal solvent which is solid at room or ambient temperature but melts at an elevated temperature may be incorporated in the light-sensitive material or dye fixing material. Such a hydrophilic thermal solvent may be incorporated in either the light-sensitive material or the dye fixing material or both the materials. In particular, the hydrophilic-thermal solvent may be incorporated in any one of the emulsion layer, intermediate layer, protective layer and/or dye fixing layer, preferably the dye fixing layer and/or adjacent layers.

Examples of such a hydrophilic thermal solvent include ureas, pyridines, amides, sulfonamides, imides, alcohols, oximes and other heterocylic compounds.

In the process for conducting development and transfer simultaneously or in sequence, the previously mentioned image formation accelerators and/or dye transfer assistants may be previously incorporated in either the dye fixing material or the light-sensitive material or both the materials or may be supplied from outside the element as described in detail in Japanese Patent Application (OPI) No. 218443/24. In such a process, the heating temperature is in the range of about 50° C. or more, preferably 60° C. or more, and is lower than the boiling point of the solvent used in transfer. For example, if the solvent used for the transfer is water, the heating temperature is preferably in the range of 60° to 100° C., both inclusive.

When the development process and the transfer process are conducted separately, the heating temperature is in the range of about 50° C. to about 250° C., preferably 80° C. to 180° C. In the transfer process, transfer can be conducted at a heating temperature ranging from room temperature to the temperature used in the heat development process, preferably about 50° C., more preferably to the temperature about 10° C. lower than that used in the heat development process.

The addition of the dye transfer assistant to the light-sensitive layer or the dye fixing layer may be accomplished by a roller coating process or a wire bar coating process as described in Japanese Patent Application (OPI) No. 181353/84, process as described in Japanese Patent Application (OPI) No. 181354/84 in which a water-absorbing member is used to apply water to a dye fixing material, a process as described in Japanese Patent Application (OPI) No. 181346/84 in which a bead is formed between a light-sensitive material and a dye fixing material so as to apply a dye transfer assistant to the materials, a process as described in Japanese Patent Application (OPI) No. 181348/84 in which a bead is formed between a water-repellent roller and a dye fixing layer so as to apply a dye transfer assistant to the layer, a dipping process, an extrusion process, a process in which a jet is sprayed through a nozzle to apply a dye transfer assistant to the material, or a process in which a pod is pressed to apply a dye transfer assistant to the material.

As described in Japanese Patent Application (OPI) No. 16455/84, the dye transfer assistant may be applied in a specified amount which has been previously measured or in excess amount which will be later adjusted to proper value by pressing by a roller or the like or drying by heating.

For example, a dye transfer assistant such as water is applied to a dye fixing material by one of the previously mentioned application methods. The dye fixing material is passed through a gap between pressure rollers so that excess dye transfer assistant is pressed out. The dye fixing layer is then superposed on a light-sensitive material.

The pressure at which the heat developable light-sensitive material and the dye fixing material are superposed on each other so that they are brought into close contact with each other varies with the embodiment and materials used. In general, the pressure is about 0.1 to about 100 kg/cm$^2$, preferably 1 to 50 kg/cm$^2$, as described in Japanese Patent Application (OPI) No. 180547/84.

The application of pressure to the heat developable light-sensitive material and the dye fixing material may be accomplished by passing the materials through a gap between a pair of rollers, pressing the materials by means of smooth plates, or by other various processes. Such rollers or plates may be heated to a temperature ranging from room temperature to the temperature used in the heat development process.

The present invention will further illustrated in the following examples, but the present invention should not be construed as being limited thereto.

EXAMPLE 1

The process for the preparation of a monodispersed emulsion of hexahedral grains of silver iodobromide will be described hereinafter.

An aqueous solution containing 69 g of potassium bromide and 2 g of potassium iodide and an aqueous solution of silver nitrate (prepared by dissolving 0.59 mol of silver nitrate in 600 ml of water) were added to an aqueous solution of gelatin (prepared by dissolving 20 g of gelatin and 0.5 g of $HO(CH_2)_2S(CH_2)_2S(CH_2)_2OH$ in 1,000 ml of water and maintaining the solution at a temperature of 50° C.) with vigorous stirring by double jet process with the pAg thereof maintained at 8.0. The solution was washed with water and desalted. Thereafter, 40 g of gelatin and 200 ml of water were added to the solution to adjust the pH value thereof. The solution was then subjected to optimum chemical sensitization by sodium thiosulfate to obtain 700 g of a monodispersed emulsion of hexahedral grains having an average grain diameter of 0.45 μm.

The process for the preparation of a dispersion of a dye forming coupler will be described hereinafter.

100 g of a 10% aqueous solution of gelatin, 10 ml of a 5% aqueous solution of sodium dodecylbenzenesulfonate, 0.014 mol (9.3 g) of a dye forming coupler A described hereinafter, 5 g of trinonyl phosphate, and 20 ml of ethyl acetate were mixed with each other. The resulting mixture was subjected to homogenization by means of a homogenizer to prepare an emulsion dispersion.

Dye forming coupler A

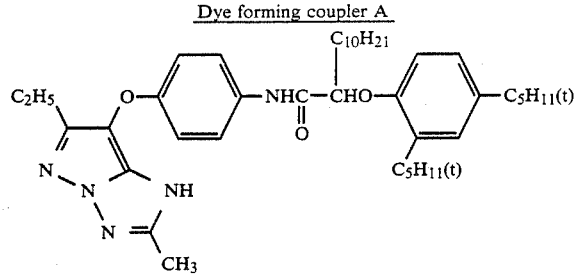

The process for the preparation of a coating solution will described hereinafter.

| | | |
|---|---|---|
| (a) | Monodispersed emulsion of hexahedral silver iodobromide | 50 g |
| (b) | 10% Aqueous solution of gelatin | 15 g |
| (c) | 0.04% Methanol solution of sensitizing dye (7) | 15 ml |
| (d) | Dispersion of dye forming coupler A | 32 g |
| (e) | 10% Methanol solution of a compound represented by the structural formula: 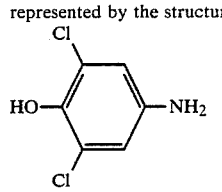 | 15 ml |
| (f) | 5% Aqueous solution of a compound represented by the structural formula: 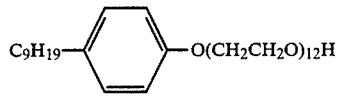 | 15 ml |
| (g) | Water | 15 ml |

The above components were mixed with stirring. The resulting mixture was then coated on a paper support laminated with a polyethylene in an amount such that the thickness of the wet film reached 30 μm. The wet film thus applied was then dried.

A mixture of 400 g of a 10% aqueous solution of gelatin, 1,600 ml of water, 20 ml of a 4% solution of 1,2-bis(vinylsulfonylacetamido)ethane, and 250 ml of a 1% aqueous solution of a succinic acid-2-ethylhexyl ester sodium salt was coated on the film and dried so that a protective layer was formed thereon. Thus, light-sensitive material 1 was prepared.

Light-sensitive materials 2 to 6 were prepared in the same manner as used in the preparation of the light-sensitive material 1 except in that dyes shown in Table 1 were used.

The light-sensitive materials 1 to 6 were exposed to light of 5,000 lux from a tungsten lamp through an optical wedge having a grade of density for 1 second. 14 ml of a 5% aqueous solution of guanidine carbonate was applied to the emulsion side of the light-sensitive material thus light-exposed. A polyethylene terephthalate film was superposed on the coated surface of the light-sensitive material. The resulting material was then clamped by a heat block having a temperature of 110° C. for 60 minutes. As a result, a sharp negative magenta image was obtained on the light-sensitive material. The density of the magenta color image was measured by means of a Macbeth reflection densitometer (RD-519). The results of the measurement are shown in Table 1.

The spectral absorption of the unexposed films was measured before and after heating. The absorbance of the sensitizing dye at the peak wavelength is shown in Table 1.

TABLE 1

| Light sensitive material No. | Sensitizing dye No. | Relative sensitivity* | Fog | Fading of sensitizing dye After heating | Fading of sensitizing dye Before heating |
|---|---|---|---|---|---|
| 1 | (7) | 1.00 | 0.22 | 0.410 | 0.115 |
| 2 | (13) | 0.95 | 0.20 | 0.665 | 0.220 |
| 3 | (25) | 1.10 | 0.21 | 0.565 | 0.130 |
| 4 | (58) | 1.05 | 0.22 | 0.700 | 0.255 |
| 5 | Comparison a | 0.90 | 0.23 | 0.395 | 0.390 |
| 6 | Comparison a' | 0.75 | 0.2 | 0.380 | 0.120 |

*The value of −log E relative to that of the light-sensitive material 1. E is the exposure at which a density of fog +0.5 is obtained.

Sensitizing dye for Comparison a

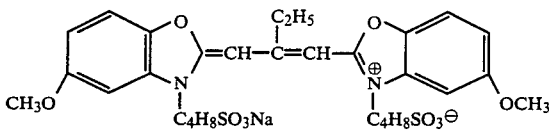

Sensitizing dye for Comparison a'

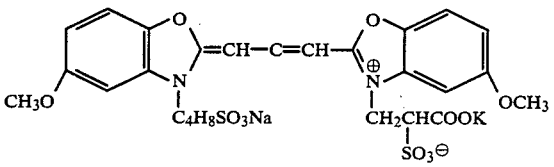

The results show that light-sensitive materials employing the sensitizing dyes of the present invention are excellent both in sensitivity and anti-fogging property as compared to the conventional structure (Comparison a and Comparison a'). It is also shown that the present sensitizing dyes are more subject to fading upon heating and thus are remarkably less apt to undesirably cause color stains.

EXAMPLE 2

The process for the preparation of a benzotriazole silver emulsion will be described hereinafter.

28 g of gelatin and 13.2 g of benzotriazole were dissolved in 3,000 ml of water. The solution thus prepared with stirred with its temperature maintained at 40° C. A solution formed by dissolving 17 g of silver nitrate in 100 ml of water was added to the solution in 2 minutes.

The pH of the benzotriazole silver emulsion was properly adjusted so that precipitation took place to remove excess salt. The pH of the emulsion was then adjusted to 6.30 to obtain 400 g of a benzotriazole silver emulsion.

A coating solution was prepared by using the silver iodobromide emulsion and dye forming coupler prepared in Example 1

| | | |
|---|---|---|
| (a-1) | Monodispersed emulsion of hexahedral silver iodobromide | 33 g |
| (a-2) | Benzotriazole silver emulsion | 33 g |
| (b–f) | Components (b) to (f) as used in Example 1 in the same amounts as in Example 1 (except in that dyes shown in Table 2 were used.) | |
| (g) | Water | 152 ml |

The above compounds (a) to (g) were mixed with each other. Light-sensitive materials 7 to 11 were prepared using the mixtures thus prepared in the same manner as used in Example 1. The light-sensitive materials thus obtained were processed in the manner as used in Example 1 to form a magenta image. The results are shown in Table 2.

TABLE 2

| Light-sensitive material No. | Sensitizing dye No. | Relative sensitivity* | Fog | Fading of sensitizing dye Before heating | Fading of sensitizing dye After heating |
|---|---|---|---|---|---|
| 7 | (7) | 1.00 | 0.15 | 0.620 | 0.215 |
| 8 | (13) | 1.10 | 0.17 | 0.565 | 0.180 |
| 9 | (48) | 1.05 | 0.16 | 0.600 | 0.230 |
| 10 | (69) | 0.95 | 0.18 | 0.625 | 0.190 |
| 11 | Comparison b | 0.90 | 0.20 | 0.595 | 0.580 |

*See note at Table 1.

Sensitizing dye for Comparison b

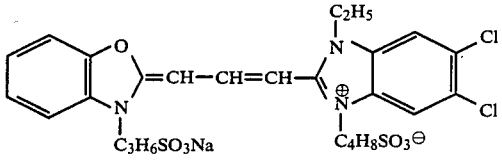

EXAMPLE 3

A coating solution of the following composition was prepared.

| | | |
|---|---|---|
| (a) | Monodispersed emulsion of hexahedral silver iodobromide prepared in Example 1 | 50 g |
| (b) | 10% Aqueous solution of gelatin | 10 g |
| (c) | 0.04% Methanol solution of the sensitizing dye (13) | 20 ml |
| (d) | Dispersion of the dye forming coupler A prepared in Example 1 | 32 g |
| (e) | Compound solution (e) prepared in Example 1 | 15 ml |
| (f) | Compound solution (f) prepared in Example 1 | 15 ml |
| (g) | 20% Aqueous dispersion of 4-methylsulfonylguanidine phenylsulfonyl acetate | 10 ml |
| (h) | Water | 163 ml |

The above components were mixed with each other. The mixture thus obtained was applied to a paper support laminated with a polyethylene in an amount such that the thickness of wet film reached 30 μm. The film thus applied was then dried.

The film thus obtained was coated with a solution which had been prepared by mixing 400 ml of a 10% aqueous solution of gelatin, 1240 ml of water, 250 ml of a 1% aqueous solution of succinic acid-2-ethylhexyl ester sodium salt, and 300 ml of a 20% water dispersion of 4-methylsulfonylguanidine phenylsulfonyl actate with stirring in an amount such that the thickness of the wet film reached 43 μm. The film thus coated as a protective layer was dried to prepare light-sensitive materials 12 to 14.

The light-sensitive materials 12 to 14 were exposed to light of 5,000 lux from a tungsten lamp through an optical wedge filter having a grade of density for 1 second. The light-sensitive materials thus exposed were heated for 30 seconds over a heat plate which had been heated to a temperature of 140° C. As a result, sharp magenta color images were obtained on the materials. The results are shown in Table 3.

TABLE 3

| Light-sensitive material No. | Sensitizing dye No. | Relative sensitivity* | Fog | Fading of sensitizing dye: Before heating | Fading of sensitizing dye: After heating |
|---|---|---|---|---|---|
| 12 | (13) | 1.00 | 0.17 | 0.580 | 0.220 |
| 13 | (55) | 0.95 | 0.19 | 0.525 | 0.230 |
| 14 | Comparison c | 0.85 | 0.21 | 0.600 | 0.580 |

*See note at Table 1.

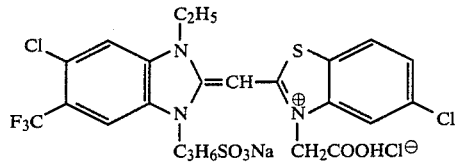

EXAMPLE 4

A benzotriazole silver emulsion was prepared in the same manner as used in Example 2.

The process for the preparation of a silver halide emulsion (B) will be described hereinafter.

600 ml of an aqueous solution containing sodium chloride and potassium bromide and an aqueous solution of silver nitrate prepared by dissolving 0.59 mol of silver nitrate in 600 ml of water were simultaneously added to an aqueous solution of gelatin (containing 20 g of gelatin and 3 g of sodium chloride in 1,000 ml of water and maintained at a temperature of 75° C.) with vigorous stirring at the same flow rate in 40 minutes. Thus, a monodispersed emulsion of cubic grains of silver chlorobromide having an average grain size of 0.35 μm (bromide content: 80 mol%) was prepared.

The emulsion thus obtained was washed with water and desalted. 5 mg of sodium thiosulfate and 20 mg of 4-hydroxy-6-methyl-1,3,3a,7-tetrazaindene were added to the emulsion thus desalted. The emulsion was then subjected to chemical sensitization at a temperature of 60° C.

The yield of the desired emulsion was 600 g.

The process for the preparation of a gelatin dispersion of a dye providing substance will be described hereinafter.

5 g of a cyan dye providing substance (A) (shown below), 0.5 g of succinic acid-2-ethylhexyl ester sodium salt, and 10 g of triisononyl phosphate were dissolved in 30 ml of ethyl acetate at a temperature of about 60° C. to prepare a homogeneous solution. The solution thus prepared and 100 g of a 10% solution of lime-treated gelatin were mixed with stirring and then dispersed at 10,000 RPM by a homogenizer for 10 minutes. The dispersion is called a dispersion of a cyan dye providing substance.

(A)

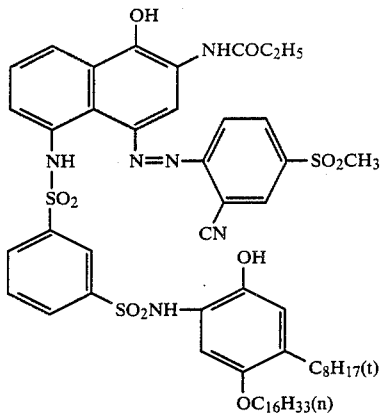

The process for the preparation of a light-sensitive coating composition will be described hereinafter.

| | |
|---|---|
| (a) Benzotriasole silver emulsion | 10 g |
| (b) Light-sensitive silver chlorobromide emulsion | 15 g |
| (c) Dispersion of a dye providing substance | 25 g |
| (d) 5% Aqueous solution of a compound of the general formula: | 5 ml |

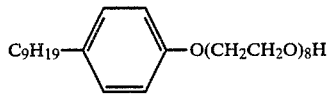

| | |
|---|---|
| (e) 10% Methanol solution of benzenesulfonamide | 5 ml |
| (f) 10% Aqueous solution of 4-methylsulfonylguanidine phenylsulfonyl acetate | 15 ml |
| (g) 0.04% Methanol solution of the sensitizing dye (49) | 16 ml |

The above components (a) to (g) were mixed with each other. A thickener (e.g., sodium polystyrene-p-sulfonate) and water were added to the mixture in amounts such that the volume thereof reached 100 ml. The solution thus prepared was applied to a polyethylene terephthalate film of 180 μm thick in an amount such that the thickness of wet film reached 50 μm.

A protective layer coating composition containing the following components was prepared.

| Protective layer coating composition | |
|---|---|
| (h) 10% Gelatin | 400 g |
| (i) 10% Aqueous solution of 4-methylsulfonyl-guanidine phenylsulfonyl acetate | 240 ml |
| (j) 4% Aqueous solution of a hardener of the general formula: $CH_2{=}CH{-}SO_2CH_2CONH{-}(CH_2)_2{-}NHCOCH_2SO_2CH{=}CH_2$ | 50 ml |

The above components were mixed with each other. A thickener and water were added to the mixture in an amount such that the volume thereof reached 1,000 ml.

The coating composition thus prepared was applied to the polyethylene terephthalate film coated with the above-mentioned light-sensitive coating composition in an amount such that the thickness of wet film reched 30 μm.

The specimen thus prepared was specified as a light-sensitive material 15. A light-sensitive material shown in Table 4 was prepared in the same manner as used for the light-sensitive material 15 except in that the sensitizing dye shown in Table 1 was used besides the sensitizing dye (49) for the component (g) in the preparation of the light-sensitive coating composition.

The light-sensitive material thus prepared was dried and then imagewise exposed to light of 2,000 lux from a tungsten lamp for one second.

The specimens thus exposed were uniformly heated for 20 seconds over a heat block which had been heated to a temperature of 150° C.

The process for the preparation of a dye fixing material will be described hereinafter.

10 g of poly(methyl acrylate-co-N,N,N-trimethyl-N-vinylbenzylammonium chloride) (proportion of methyl acrylate to vinylbenzylammonium chloride is 1:1) was dissolved in 200 ml of water. The solution thus obtained was uniformly mixed with 100 g of a 10% lime-processed gelatin. The mixed solution was then uniformly applied to a paper support laminated with a polyethylene having titanium dioxide dispersed therein in an amount such that the thickness of wet film reached 90 μm. The specimen was then dried. The specimen thus dried was used as a dye fixing material having a mordant layer.

Water was supplied to the film side of the dye fixing material in an amount of 20 ml per $m^2$ of the material. The above-mentioned coated specimen was superposed on the dye fixing material in such a manner that the respective film sides were brought into contact with each other.

The resulting material was then heated for 6 seconds over a heat block which had been heated to a temperature of 80° C. The dye fixing material was then peeled apart from the light-sensitive material to obtain a cyan color image on the dye fixing material.

The unexposed light-sensitive material was treated in the same manner as described above. The spectral absorption of the dye fixing material was measured to determine the transferred amount of the sensitizing dye.

The results are shown in Table 4.

TABLE 4

| Light-sensitive material No. | Sensitizing dye No. | Relative sensitivity* | Fog | Transfer without 150° C. - 20 sec. heating | Transfer upon 150° C. - 20 sec. heating |
|---|---|---|---|---|---|
| 15 | (49) | 1.00 | 0.12 | 0.200 | 0.050 |
| 16 | (16) | 0.90 | 0.11 | 0.175 | 0.035 |
| 17 | (19) | 0.95 | 0.13 | 0.250 | 0.060 |
| 18 | Comparison d | 0.85 | 0.13 | 0.195 | 0.180 |
| 19 | Comparison d' | 0.60 | 0.12 | 0.205 | 0.075 |

*See note at Table 1.

Sensitizing dye for Comparison d

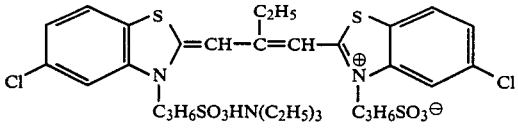

Sensitizing dye for Comparison d'

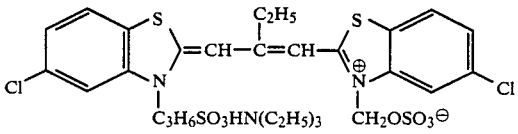

EXAMPLE 5

An example of a heat developable black-and-white light-sensitive material will be described hereinafter.

A light-sensitive material 20 was prepared as follows:

| | | |
|---|---|---|
| (a) | Silver iodobromide (same as described in Example 1) | 10 g |
| (b) | Benzotriazole silver emulsion (same as described in Example 2) | 80 g |
| (c) | 10% Ethanol solution of guanidine trichloroacetate | 10 cc |
| (d) | 5% Methanol solution of a compound of the structural formula: 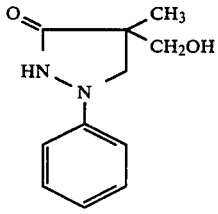 | 20 cc |
| (e) | 0.04% Methanol solution of the sensitizing dye (7) | 10 ml |

The coating solution thus prepared was applied to a polyethylene terephthalate support in an amount such that the thickness of the wet film reached 60 μm.

The light-sensitive material thus prepared was them imagewise exposed to light of 2,000 lux from a tungsten lamp for 5 seconds. The light-sensitive material thus exposed was then uniformly heated for 40 seconds over a heat block which had been heated to a temperature of 130° C. As a result, a negative image was obtained.

Light-sensitive materials 20 to 23 were prepared using the sensitizing dyes shown in Table 5 in the same manner as described above. These light-sensitive materials were treated in the same manner as described above. The fading of the sensitizing dyes was measured in the same manner as used in Example 1.

The results are shown in Table 5.

TABLE 5

| Light-sensitive material No. | Sensitizing dye No. | Relative sensitivity* | Fog | Fading of sensitizing dye: Before heating | Fading of sensitizing dye: After heating |
|---|---|---|---|---|---|
| 20 | (7) | 1.00 | 0.21 | 0.420 | 0.105 |
| 21 | (13) | 0.90 | 0.24 | 0.380 | 0.120 |
| 22 | Comparison a | 0.75 | 0.23 | 0.410 | 0.400 |
| 23 | Comparison a' | 0.65 | 0.22 | 0.425 | 0.110 |

(Comparison a and Comparison a' are the same as described in Example 1)
*See note at Table 1.

While the invention has been described in detail with reference to specific embodiments thereof, it will be apparent to one skilled in the art that various changes and modifications can be made therein without departing from the spirit and scope thereof.

What is claimed is:

1. A heat developable light-sensitive material, comprising a silver halide spectrally sensitized by a polymethine dye containing at least one basic nucleus, wherein said dye contains, as a group for substituting nitrogen atoms in said basic nucleus, at least one of the groups represented by general formulae (A) and (B):

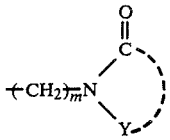

(A)

wherein m represents an integer of 1 or 2; Y represents an atomic group necessary for the formation of a cyclic imido group; and R represents a $C_{1-4}$ alkyl group.

2. A heat developable light-sensitive material as claimed in claim 1, wherein said atomic group represented by Y is selected from the group consisting of a succinic acid imido group, a phthalic acid imido group, an orthobenzosulfimido group, and a maleimido group wherein said atomic group may be optionally substituted by a halogen atom, a nitro group, a carboxyl group, an acylamino group or an alkoxycarbonyl amino group.

3. A heat developable light-sensitive material as claimed in claim 1, wherein said polymethine dye is used in combination for supersensitization of said silver halide grains.

4. A heat developable light-sensitive material as claimed in claim 1, wherein said dye is present in an amount from about $10^{-8}$ to about $10^{-2}$ mol per mol of silver halide.

5. A heat developable light-sensitive material as claimed in claim 1, wherein said silver halide grains have an average grain diameter from about 0.001 to about 10 m.

6. A heat developable light-sensitive material as claimed in claim 1, wherein said silver halide is coated in an amount from about 1 mg to about 10 g/m$^2$ calculated in terms of the amount of silver.

7. A heat developable light-sensitive material as claimed in claim 1, wherein said material further comprises an organic metal salt.

8. A heat developable light-sensitive material as claimed in claim 7, wherein said organic metal salt is an organic silver salt.

9. A heat developable light-sensitive material as claimed in claim 1, wherein said material further comprises a base and/or base precursor, a dye providing substance, an image forming substance, a reducing substance, an image formation accelerator, a development stopper, an anti-fogging agent, and/or an image toner.

10. A heat developable light-sensitive material as claimed in claim 1, wherein said dye is a dye represented by the following general formula (I):

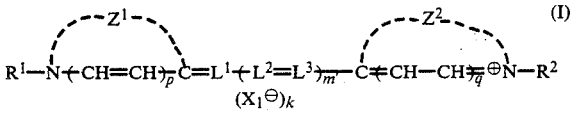

(I)

wherein $Z^1$ and $Z^2$, which may be the same or different each represents a non-metallic atomic group necessary for the formation of a 5- or 6-membered heterocyclic ring; $R^1$ and $R^2$, which may be the same or different, each represents a substituted or unsubstituted alkyl group, the groups represented by (A) and (B) as in claim 1 being contained in either $R^1$ or $R^2$; $L^1$, $L^2$ and $L^3$ each represents a substituted or unsubstituted methine group; p and q each represents 0 or 1; m' represents 0, 1, 2, or 3; $X_1\ominus$ represents an anion; and k represents 0 or 1.

11. A heat developable light-sensitive material as claimed in claim 1, wherein said dye is a dye represented by the following general formula (II):

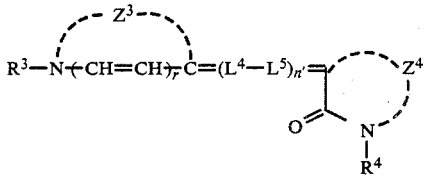

(II)

wherein $Z^3$ represents a non-metallic atomic group necessary for the formation of a 5- or 6-membered heterocyclic ring; $R^3$ represents a substituted or unsubstituted alkyl group; $L^4$ and $L^5$ each represents a substituted or unsubstituted methine group; $Z^4$ represents a non-metallic atomic group necessary for the formation of a 5- or 6-membered heterocyclic ring; $R^4$ represents a hydrogen atom or a substituted or unsubstituted alkyl group, a substituted or unsubstituted aryl group or a heterocyclic group, the groups represented by (A) and (B) as in claim 1 being contained in $R^3$; r represents 0 or 1; and n' represents 0, 1, 2, or 3.

12. A heat developable light-sensitive material as claimed in claim 1, wherein said dye is a dye represented by the following general formula (II):

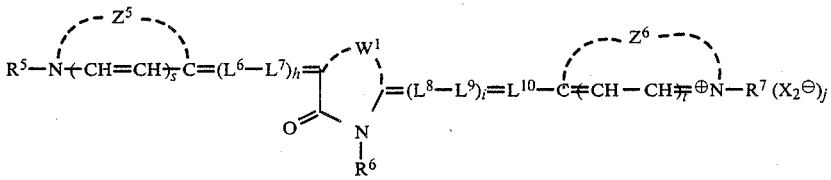

(III)

wherein $Z^5$ and $Z^6$, which may be the same or different, each represents a non-metallic atomic group necessary for the formation of a 5- or 6-membered heterocyclic ring; $R^5$ and $R^7$, which may be the same or different, each represents a substituted or unsubstituted alkyl group, $R^6$ represents a hydrogen atom or a substituted or unsubstituted alkyl group, a substituted or unsubstituted aryl group or a heterocyclic group, $L^6$, $L^7$, $L^8$, $L^9$ and $L^{10}$ represents a substituted or unsubstituted methine group; $W^1$ represents an atomic group necessary for the formation of a 5- or 6-membered heterocyclic ring, the groups represented by (A) and (B) as in claim 1 being contained in either $R^5$ or $R^7$; h and i each represents 0, 1, 2, or 3; s and t each represents 0 or 1; $X_2\ominus$ represents an anion; and j represents 0 or 1.

13. A heat developable light-sensitive material as claimed in claim 1, wherein the dye is a dye represented by the following general formula (IV):

(IV)

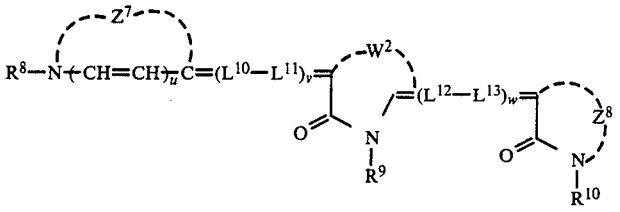

wherein $Z^7$ represents a non-metallic atomic group necessary for the formation of a 5- or 6-membered heterocyclic ring; $Z^8$ represents a non-metallic atomic group necessary for the formation of a 5- or 6-membered heterocyclic ring; $W^2$ represents an atomic group necessary for the formation of a 5- or 6-membered heterocyclic ring, $R^8$ represents a substituted or unsubstituted alkyl group, $R^9$ and $R^{10}$, which may be the same or different, each represents a hydrogen atom or a substituted or unsubstituted alkyl group, a substituted or unsubstituted aryl group or a heterocyclic group, $L^{10}$, $L^{11}$, $L^{12}$ and $L^{13}$ each represents a substituted or unsubstituted methine group, the groups represents by (A) and (B) as in claim 1 being contained in $R^8$; v and w each represents 0, 1, 2, or 3; and u represents 0 or 1.

14. A heat developable light-sensitive material as claimed in claim 1, wherein said dye is a dye represented by the following general formula (V):

(V)

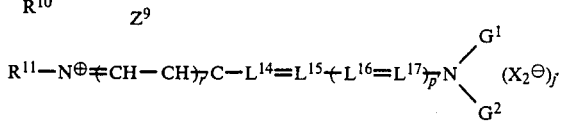

wherein $Z^9$ represents a non-metallic atomic group necessary for the formation of a 5- or 6-membered heterocyclic ring; $R^{11}$ represents a substituted or unsubstituted alkyl group, $L^{14}$, $L^{15}$, $L^{16}$ and $L^{17}$ each represents a substituted or unsubstituted methine group; r' represents 0 or 1; $X_2\ominus$ represents an anion; j' represents 0 or 1; p' represents 0, 1 or 2; and $G^1$ and $G^2$, which may be the same or different, each represents a hydrogen atom, a substituted or unsubstituted alkyl group, or a substituted or unsubstituted aryl group, or $G^1$ and $G^2$ together form a ring derived from a cyclic secondary amine, with the proviso that the groups represented by (A) and (B) as in claim 1 are contained in $R^{11}$.

* * * * *